US011841032B2

(12) United States Patent
Leither et al.

(10) Patent No.: US 11,841,032 B2
(45) Date of Patent: Dec. 12, 2023

(54) FAN ASSEMBLY WITH COMPONENTS FOR QUICK ASSEMBLY

(71) Applicant: Pinnacle Climate Technologies, Inc., Eden Prairie, MN (US)

(72) Inventors: Christopher Leither, Eden Prairie, MN (US); Dennis Meyer, Eden Prairie, MN (US)

(73) Assignee: Pinnacle Climate Technologies, Inc., Eden, Prairie, MN (US)

( * ) Notice: Subject to any disclaimer, the term of this patent is extended or adjusted under 35 U.S.C. 154(b) by 150 days.

(21) Appl. No.: 17/028,607

(22) Filed: Sep. 22, 2020

(65) Prior Publication Data

US 2021/0310495 A1 Oct. 7, 2021

Related U.S. Application Data

(60) Provisional application No. 63/003,532, filed on Apr. 1, 2020.

(51) Int. Cl.

| | |
|---|---|
| ***F04D 29/52*** | (2006.01) |
| ***F04D 25/08*** | (2006.01) |
| ***F04D 29/70*** | (2006.01) |
| ***F04D 29/64*** | (2006.01) |

(52) U.S. Cl.

CPC ..... *F04D 29/522* (2013.01); *F04D 25/08* (2013.01); *F04D 29/646* (2013.01); *F04D 29/703* (2013.01)

(58) Field of Classification Search

CPC ..... F04D 25/08; F04D 29/703; F04D 19/002; F04D 29/52–522; F04D 29/526; F04D 29/644–646

USPC ..... 416/247 R

See application file for complete search history.

(56) References Cited

U.S. PATENT DOCUMENTS

| | | | | |
|---|---|---|---|---|
| 2,037,250 | A * | 4/1936 | MacDonald | F04D 25/10 415/125 |
| 5,441,391 | A * | 8/1995 | Frost | F04D 19/002 417/362 |
| 5,575,622 | A * | 11/1996 | Zimmerman | F04D 29/703 415/223 |
| 5,749,708 | A * | 5/1998 | Matson | F04D 25/02 416/247 R |
| 6,474,956 | B2 | 11/2002 | Davis et al. | |
| 6,790,009 | B1 * | 9/2004 | Carbajal | F04D 29/703 416/247 R |
| 7,137,772 | B2 | 11/2006 | Blateri | |

* cited by examiner

*Primary Examiner* — Alexander B Comley
(74) *Attorney, Agent, or Firm* — Merchant & Gould P.C.

(57) ABSTRACT

A fan assembly designed for quick assembly and disassembly can include a housing, a fan and a motor disposed within the housing, a first guard located on a first side and a second guard located on a second side of the housing. The fan assembly can include a tensioner mechanism provided on an exterior of the housing to secure the first and the second guards to the housing. The fan assembly can be assembled by securing a plurality of struts to an interior side of a housing, mounting a fan and motor to the plurality of struts, inserting first and second guards within the housing proximate the inlet and outlet ends, and tensioning the first and second free ends of the housing to secure the first and second guards within the housing.

18 Claims, 25 Drawing Sheets

FAN ASSEMBLY WITH COMPONENTS FOR QUICK ASSEMBLY

CROSS-REFERENCE TO A RELATED APPLICATION

This application includes the disclosure of U.S. Provisional Application Ser. No. 63/003,532, filed Apr. 1, 2020. The complete disclosure of U.S. Application Ser. No. 63/003,532 is incorporated herein by reference. A claim of priority is made to U.S. Provisional Application Ser. No. 63/003,532, to the extent appropriate.

TECHNICAL FIELD

The present disclosure relates generally fan assemblies.

BACKGROUND

Large industrial fans used for circulating air through factories and warehouses for cooling is generally known. For example, a standard industrial fan is shown and described at U.S. Pat. No. 6,474,956. Fans of this type, especially large industrial fans, are time consuming to assemble. Improvements are needed.

SUMMARY

A fan assembly can include a housing extending between an inlet end and an outlet end, a fan and a motor disposed within the housing, a first guard located proximate the housing inlet end, a second guard located proximate the housing outlet end, and a tensioner mechanism securing the first and the second guards to the housing by drawing a first end of the housing towards a second end of the housing.

In some examples, the tensioner mechanism includes one or more tensioner bolts.

In some examples, the tensioner mechanism further includes a spring.

In some examples, the tensioner mechanism is a draw latch.

In some examples, the first and second guards each include one or more radial extensions extending into apertures defined within the housing.

In some examples, each of the radial extensions is configured as a wire loop.

In some examples, each of the radial extensions is configured as a wire hook.

In some examples, each of the radial extensions is configured as a straight pin.

In some examples, the fan assembly also includes a plurality of struts located on an interior of the housing to provide support for the motor and fan.

In some examples, there are three struts provided on the interior of the housing.

In some examples, there are four or more struts provided on the interior of the housing.

In some examples, the fan assembly further includes a pair of wheels supported by an axle, wherein the axle is supported by the tensioner mechanism.

A fan assembly can include a housing extending between an inlet end and an outlet end, a fan and a motor disposed within the housing, a first guard located proximate the housing inlet end, and a second guard located proximate the housing outlet end, wherein the first and second guards each include a plurality of radial extensions extending into corresponding apertures defined within the housing.

In some examples, each of the radial extensions is configured as a wire loop.

In some examples, each of the radial extensions is configured as a wire hook.

In some examples, each of the radial extensions is configured as a straight pin.

In some examples, a plurality of struts located on an interior of the housing are provided to provide support for the motor and fan.

In some examples, there are three struts provided on the interior of the housing.

In some examples, there are four or more struts provided on the interior of the housing.

In some examples, the fan assembly further includes a pair of wheels supported by an axle, wherein the axle is supported by the tensioner mechanism.

A method of assembling a fan assembly can include providing a fan housing extending between first and second free ends and extending between an inlet end and an outlet end, securing a plurality of struts to an interior side of the housing, mounting a fan and motor to the plurality of struts, inserting first and second guards within the housing proximate the inlet and outlet ends, and tensioning the first and second free ends of the housing to secure the first and second guards within the housing.

The method can further include the step of inserting radial extensions associated with the first and second guards into apertures of the fan housing prior to the tensioning step.

In some examples, the tensioning step is performed by tensioning a tensioner mechanism mounted to the housing.

A variety of additional aspects will be set forth in the description that follows. The aspects relate to individual features and to combinations of features. It is to be understood that both the forgoing general description and the following detailed description are exemplary and explanatory only and are not restrictive of the broad inventive concepts upon which the examples disclosed herein are based.

DETAILED DESCRIPTION

Figure 1:
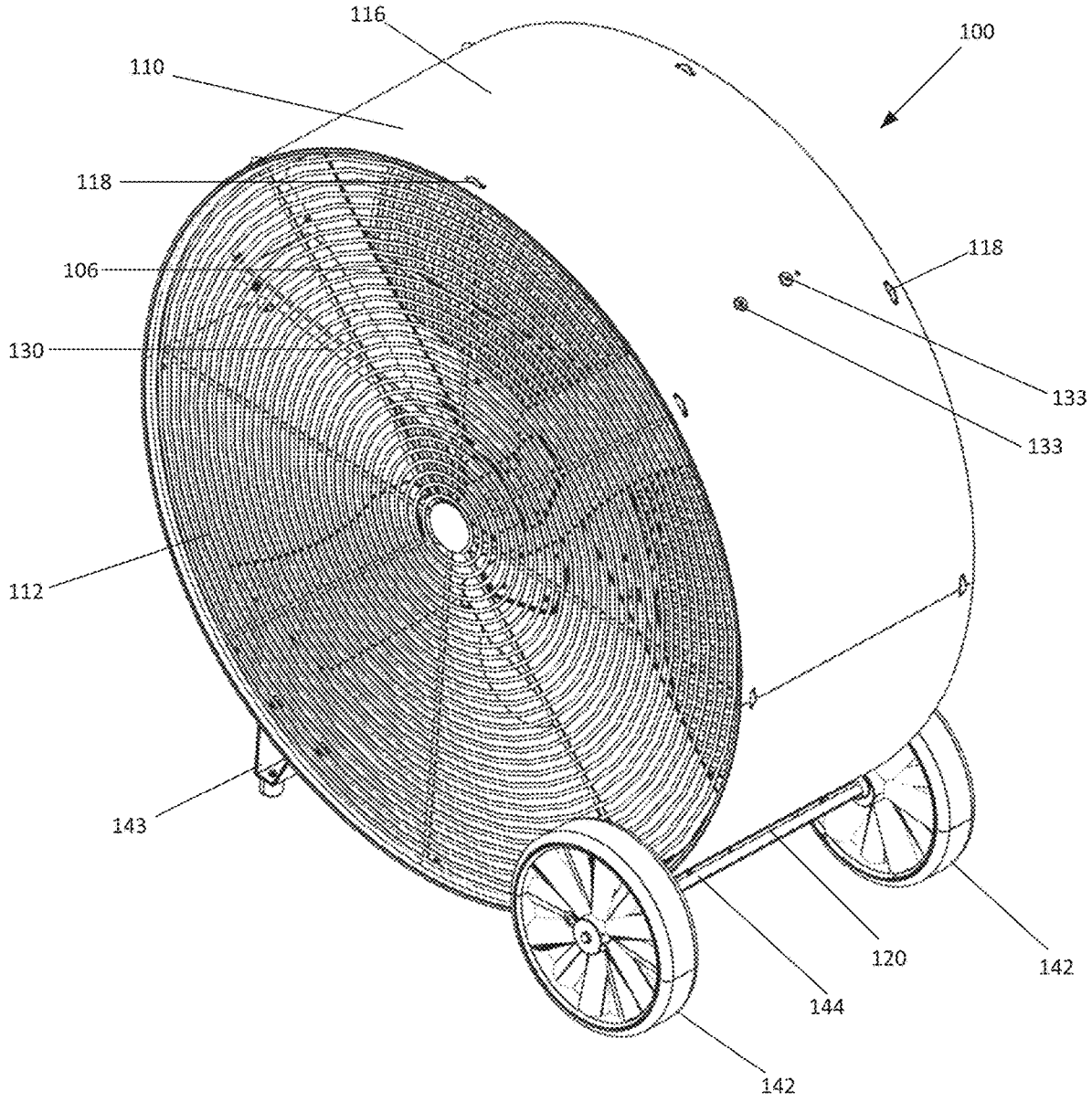
FIG. 1 is a perspective view of an example fan assembly in accordance with the present disclosure.
Figure 2:
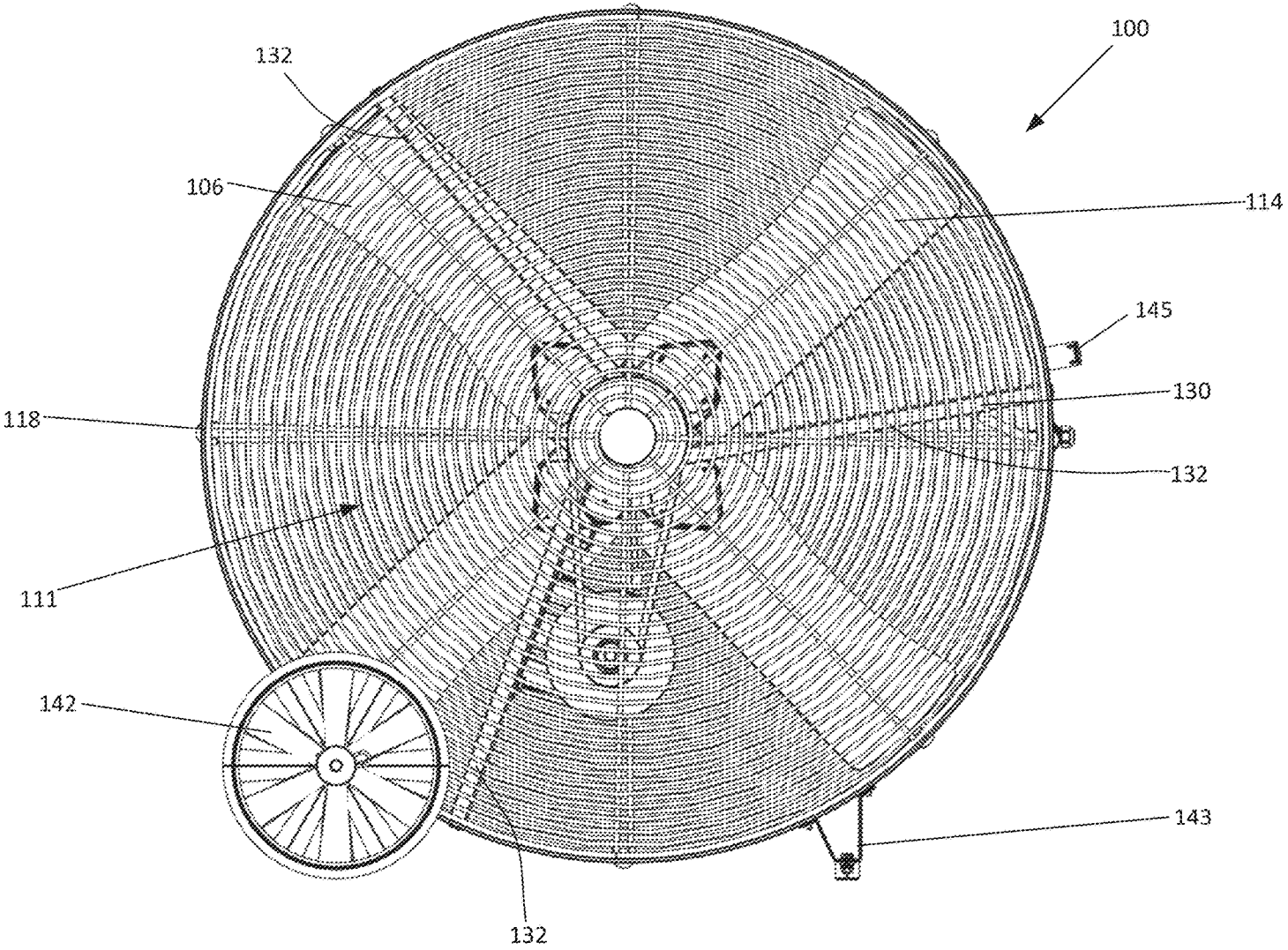
FIG. 2 is a front view of the fan assembly of FIG. 1.
Figure 3:
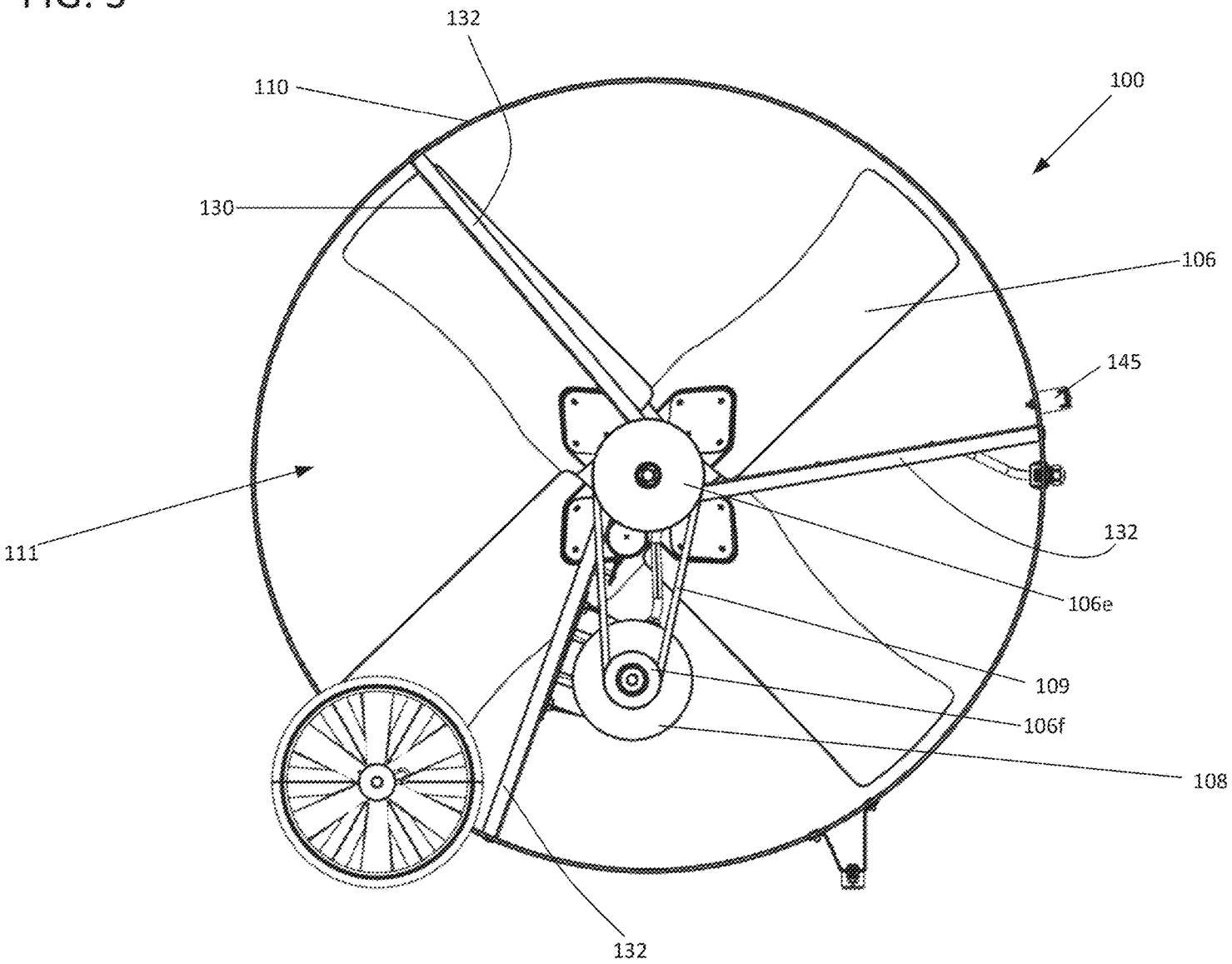
FIG. 3 is a front view of the fan assembly of FIG. 1 with the fan guards removed.
Figure 4:
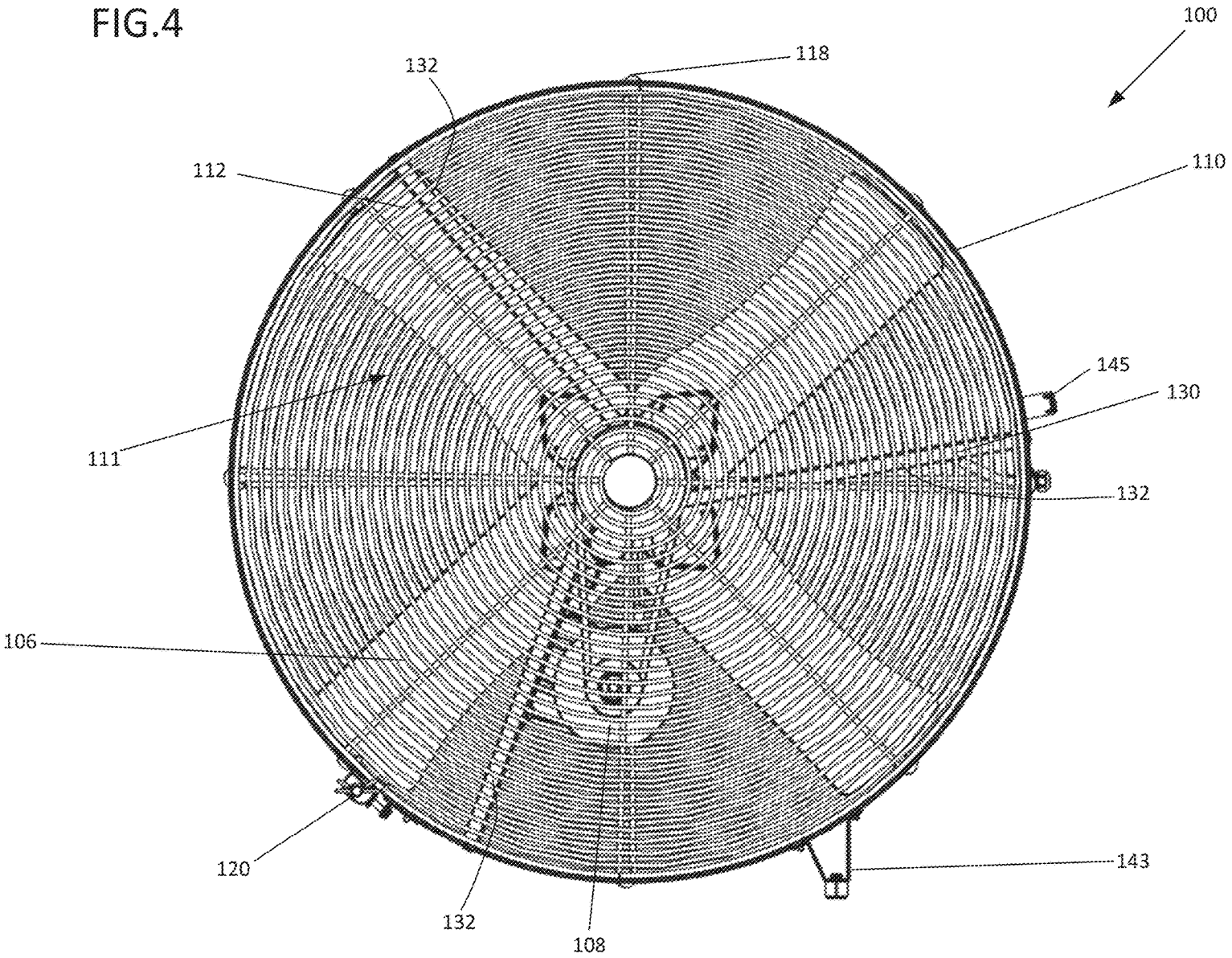
FIG. 4 is a front view of the fan assembly of FIG. 1 with a wheel removed.
Figure 5:
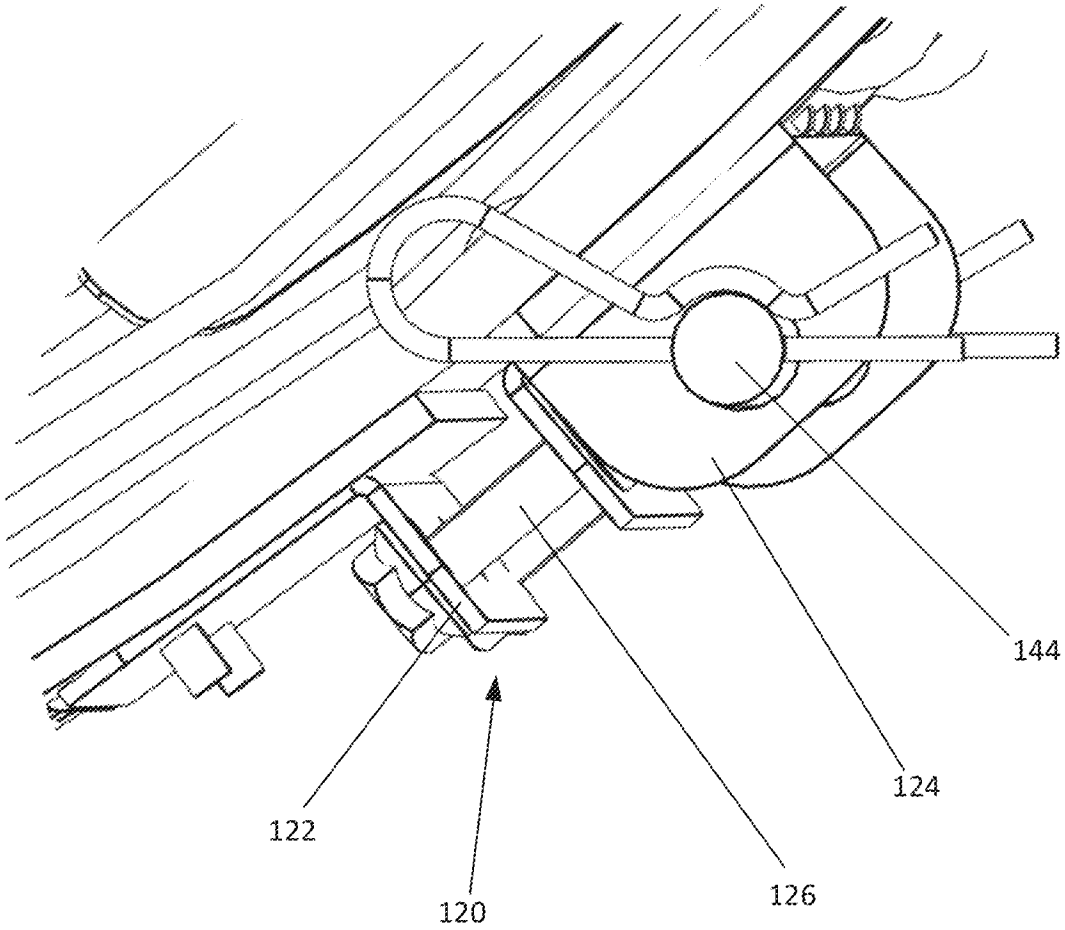
FIG. 5 is a perspective side view of a portion of the fan assembly of FIG. 1, showing a tensioner mechanism of the fan assembly.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible examples for the appended claims. Referring to the drawings wherein like reference numbers correspond to like or similar components throughout the several figures.

Referring to FIGS. 1 to 4, an example fan assembly 100 is presented. In one aspect, the fan assembly 100 includes a housing 110, a first guard 112 mounted at a first side 102 of the housing 110, and a second guard 114 mounted at a second side 104 of the housing 110. The fan assembly 100 also includes a fan 106 having a plurality of blades 106*a* and a motor 108 disposed within the housing 110 and between the first and second guards 112, 114. In the example shown, a belt 109 operably connects the motor 108 to a shaft 106*d* of the fan 106 via pulleys 106*e*, 106*f*. A direct drive arrangement is also possible. Additionally, the fan assembly 100 includes a tensioner mechanism 120 provided on an exterior surface 116 of the housing 110 to secure the first and the second guards 112, 114 to the housing 110. The fan assembly 100 is also shown as being provided with a pair of wheels 142 mounted to a common axle 144 and a pair of legs 143 mounted to the housing 110. In a resting position, the wheels 142 and legs 143 provide a stable base for the fan assembly 100 during operation. A handle 145 is also shown as being mounted to the housing 110 which enables an operator to lift the legs 143 off the floor and to then easily maneuver and guide the fan assembly 100 around via the wheels 142.

An advantage of the disclosed configuration is that the time and number of operations required to assemble the fan assembly 100 is greatly reduced in comparison to a standard fan of the same type, while providing a fan assembly with advantageous structural integrity. This reduction in manufacturing and assembly time can be attributed to the design of the housing 110, guards 112, 114, and tensioner mechanism 120 which allow for the guards 112, 114 to be secured to the housing 110 by operation of the tensioner mechanism 120 without the use of additional fasteners. In contrast, typical fan assemblies utilize numerous separate fasteners are utilized to secure guards to a housing that are time consuming to install. These types of fasteners can become loose over time due to vibrations generated during operation of the fan assembly, a problem solved by the fan assembly of the present disclosure. It is also noted that the disclosed configuration also reduces the time required to service the fan 106 and/or motor 108 in that either guard 112, 114 can be quickly by simply loosening the tensioner mechanism 120 to a sufficient degree rather than removing numerous fasteners.

Figure 15:
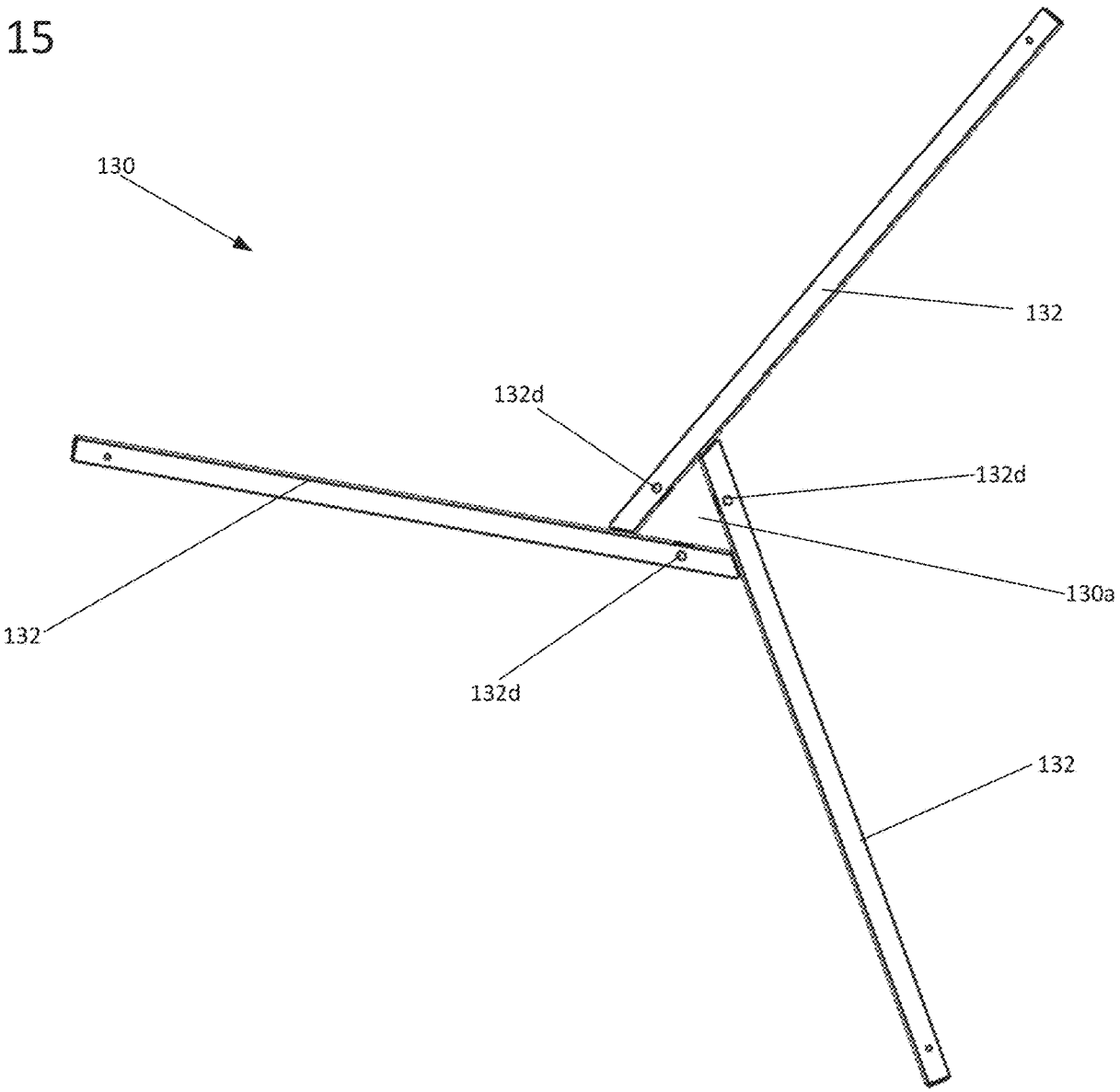
FIG. 15 is a front view of a support assembly of the fan assembly of FIG. 1.
Figure 22:
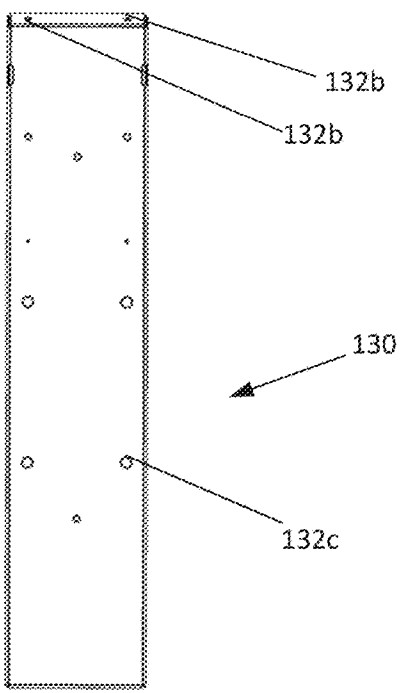
FIG. 22 is a front view of the strut of FIG. 21.
Figure 21:
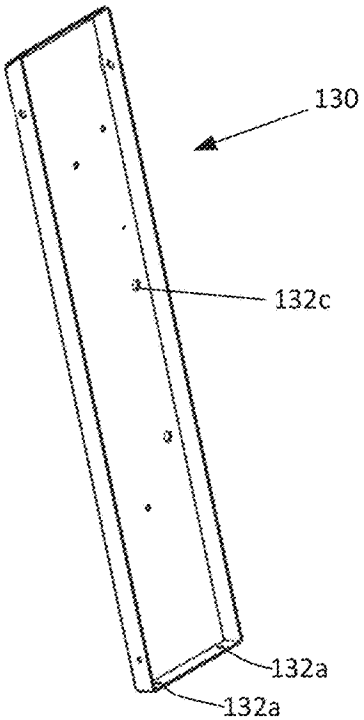
FIG. 21 is a perspective view of a strut of the support assembly shown at FIG. 15.
Figure 23:
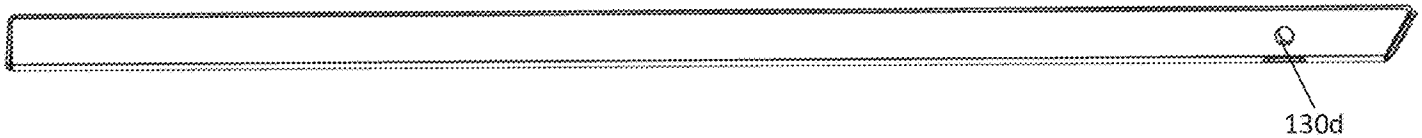
FIG. 23 is a side view of the strut of FIG. 21.

In one aspect, the fan 106 and motor 108 are located within the housing 110 and can be supported by a support assembly 130. As shown, the support assembly 130 includes a plurality of interconnected struts 132. As most easily seen at FIG. 3, three struts 132 are shown disposed at a radial angle of 120 degrees from each other. As shown, each strut 132 extends radially to the inside surface of the housing 110. As can be seen at FIGS. 21-23, each strut 132 is provided with openings 132*a* to receive fasteners 133 for securing the struts 132 to the housing 110. As can be seen, the struts 132 are disposed within an interior 111 of the housing and the openings 132*a* extend from the interior 111 of the housing 110 to the exterior surface 116 of the housing 110. In the example shown, fasteners 133 are rivets. However, other types of fasteners 133 may be used, such as screws, bolts, and clips. Each strut 132 is also shown as being provided with openings 132*b* for receiving fasteners such that the struts 132 can be connected together with fasteners, as is shown at FIG. 15 where the interconnected struts 132 form a central aperture 130*a* for receiving and supporting the fan bearing block 106*b* of the fan 106. In one aspect, the struts 132 are provided with openings 132*d* for receiving fasteners 106*c*, such as rivets, to support either the fan bearing block 106*b*, in a belt-drive configuration, or the motor 108, in a direct drive configuration. This configuration increases the strength of the support assembly 130 as well as allowing a shaft 106*d* of the fan 106 to be aligned along a center axis of the fan assembly 100. In the example shown, the struts 132 are further provided with apertures 132*c* for supporting the motor 108 with additional fasteners. In the example shown, the struts 132 are identically configured as metal channels bent from initially flat sheet stock material. Other configurations are possible. For example, the struts 132 could be welded together or formed form a different material. Additionally, other support assemblies are possible, for example, the motor and fan could be supported on an oscillating tower.

Figure 17:
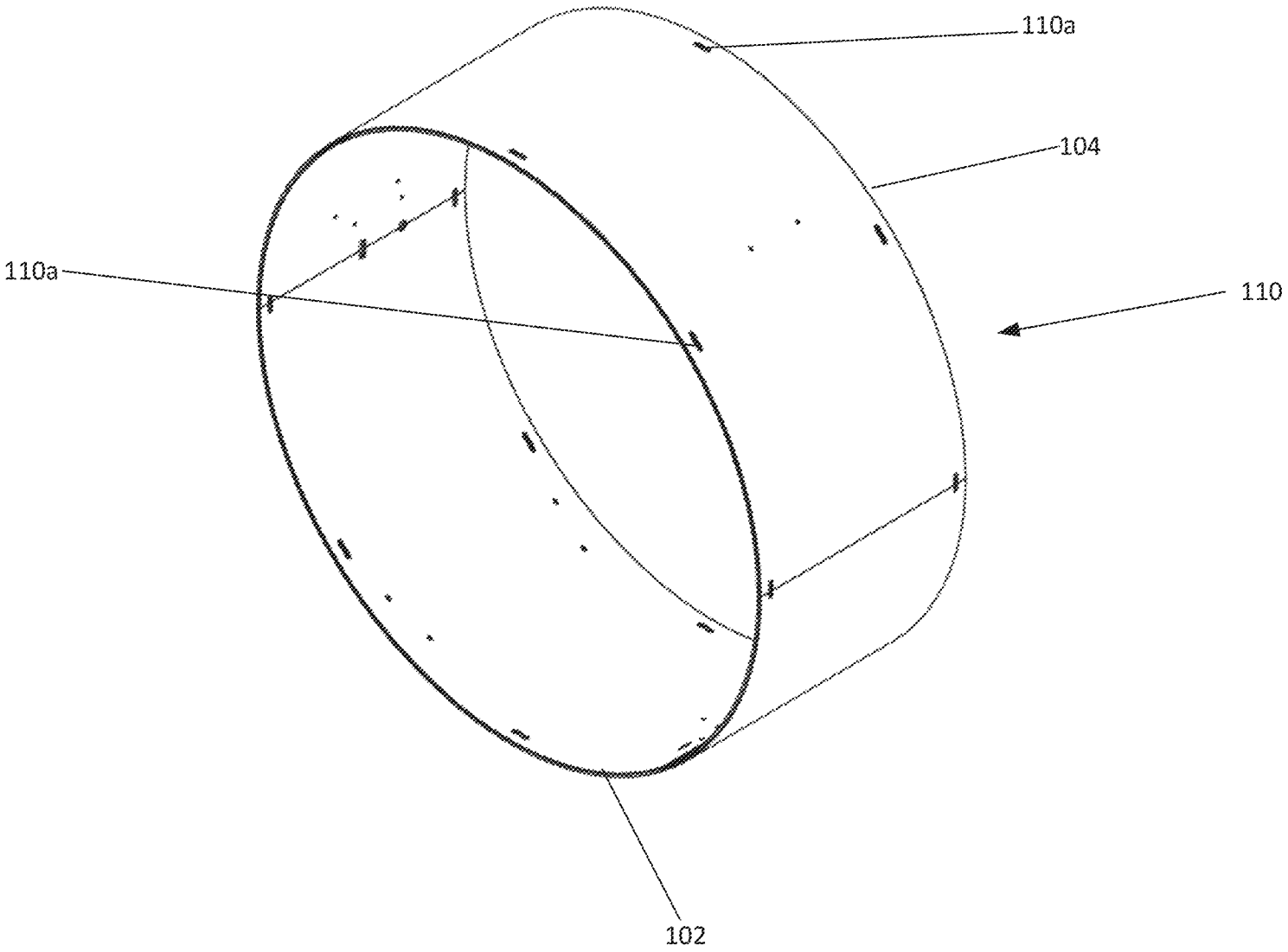
FIG. 17 is a perspective view of a housing of the fan assembly of FIG. 1.
Figure 18:
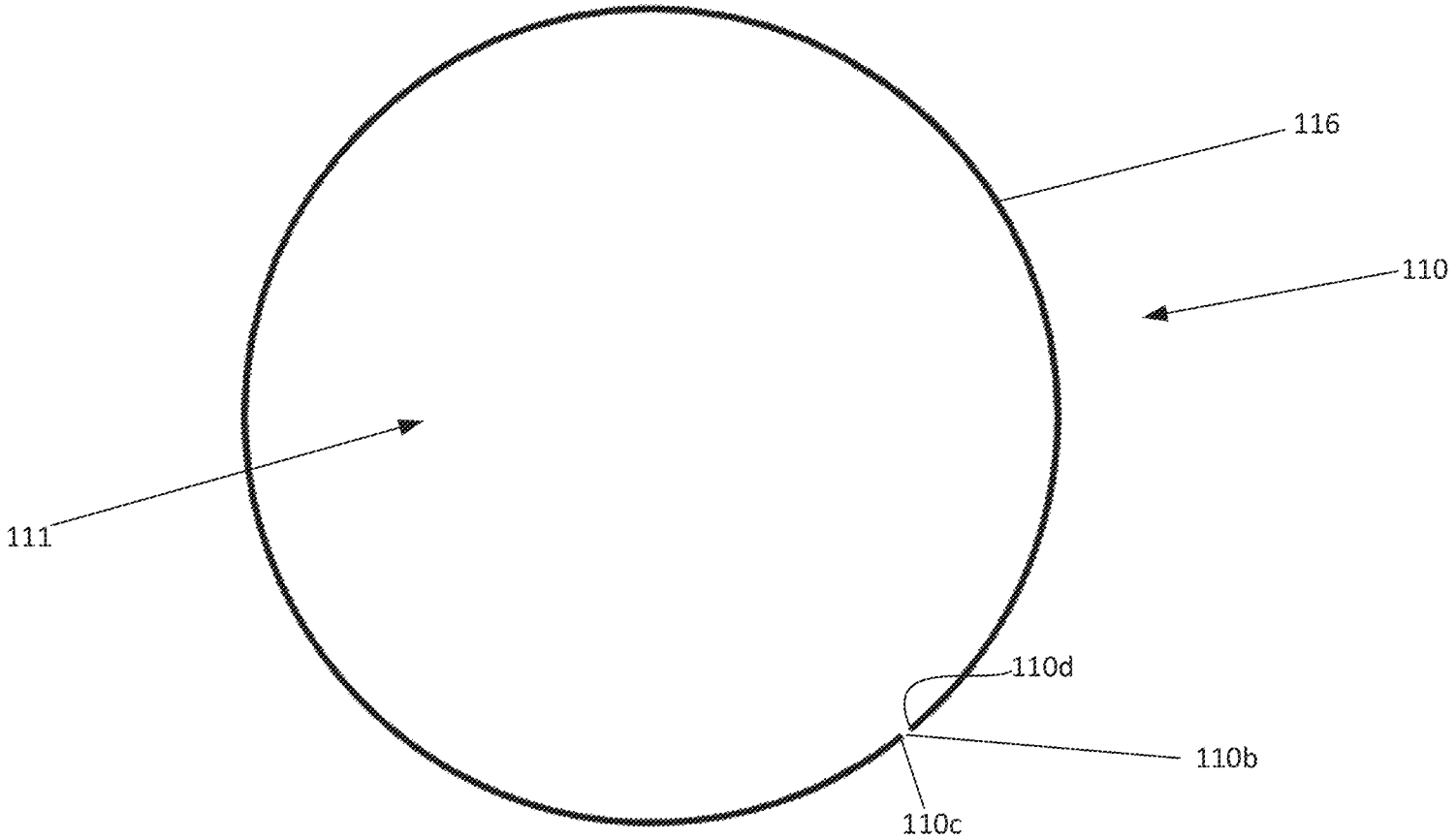
FIG. 18 is a front view of the housing of FIG. 17.
Figure 19:
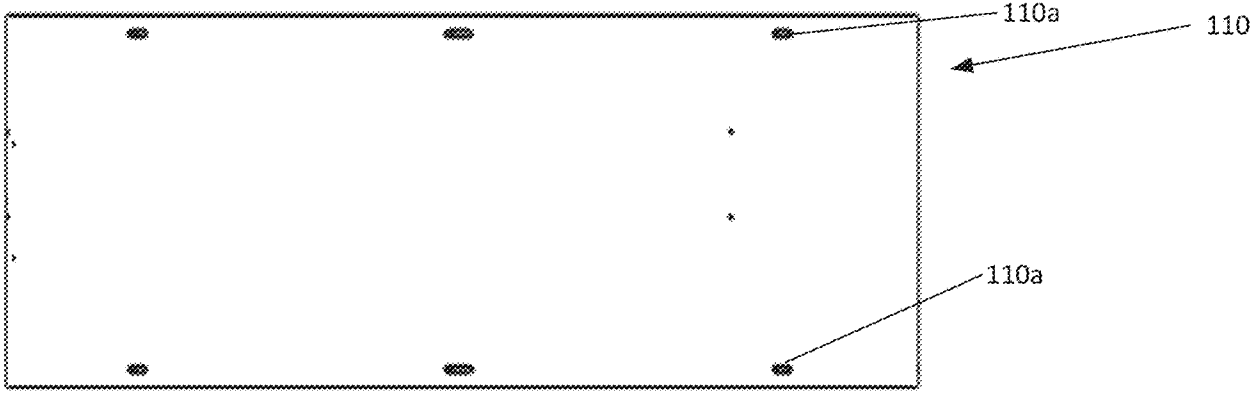
FIG. 19 is a top view of the housing of FIG. 17.
Figure 20:
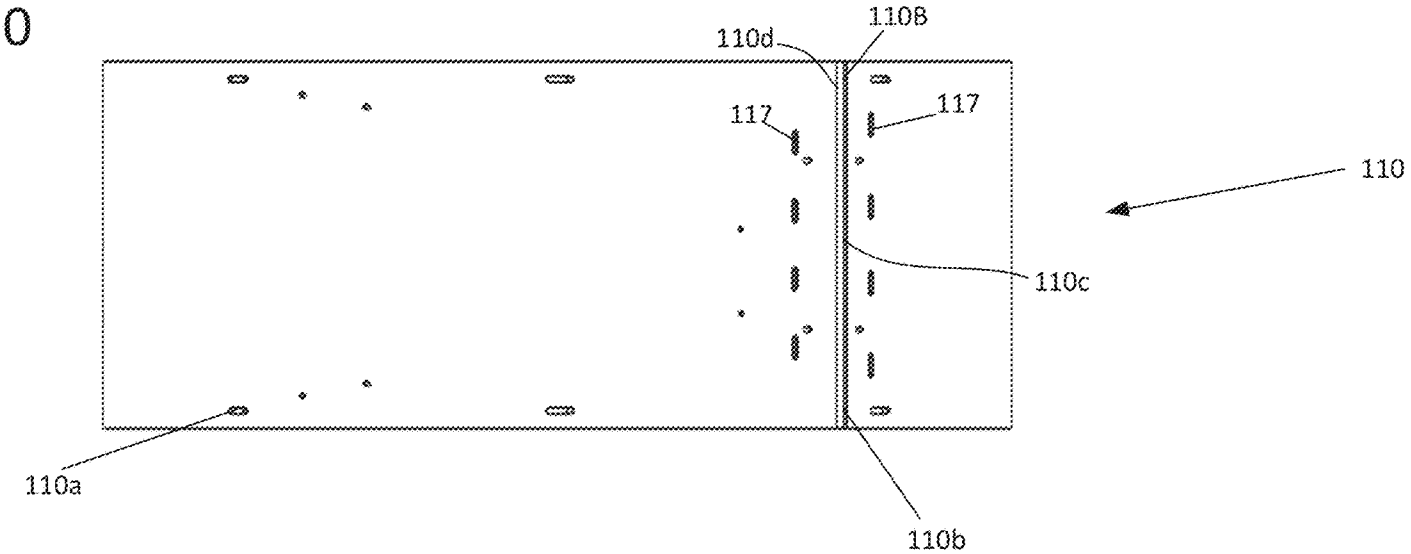
FIG. 20 is a bottom view of the housing of FIG. 17.
Figure 24:
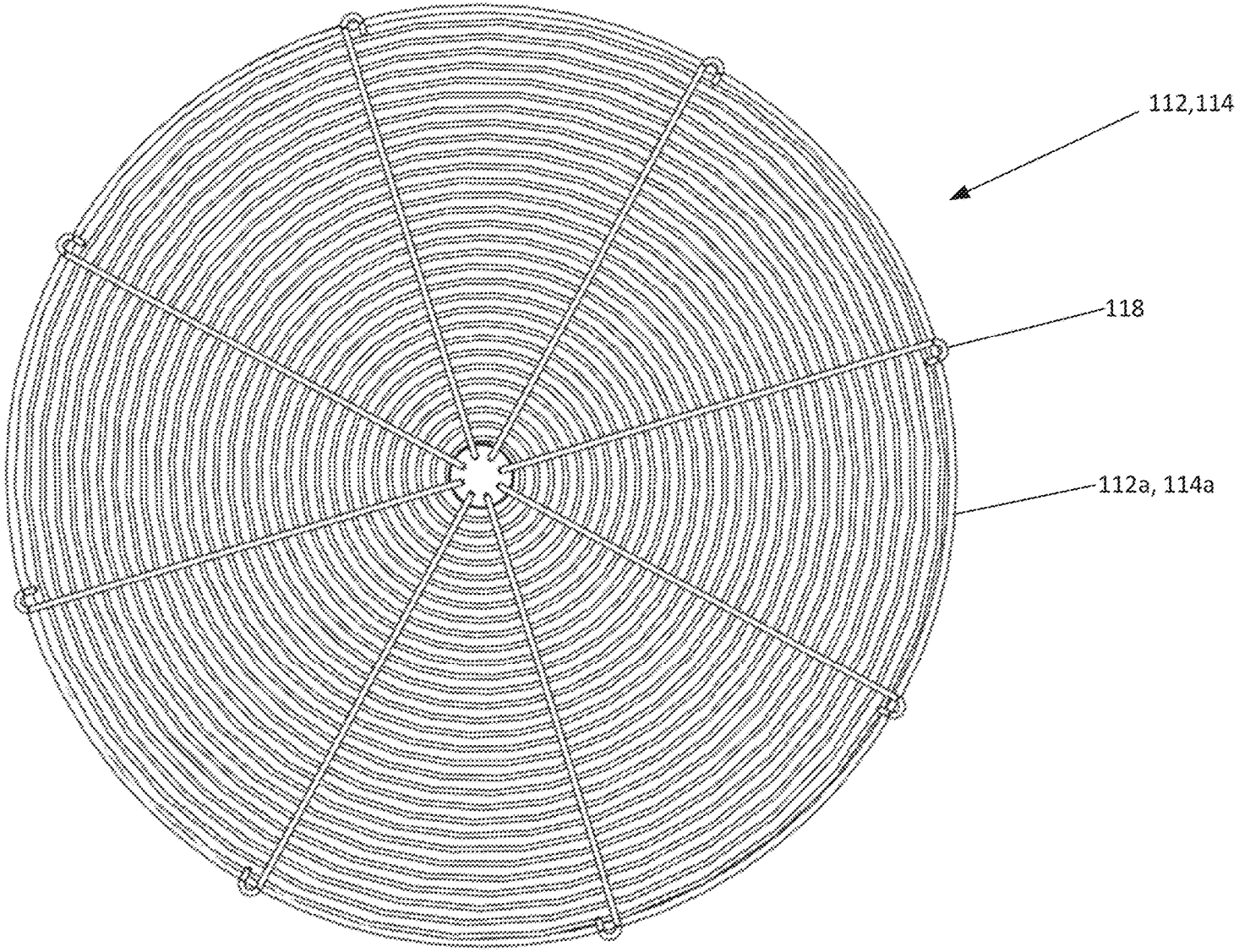
FIG. 24 is a front view of a guard of the fan assembly of FIG. 1.
Figure 25:
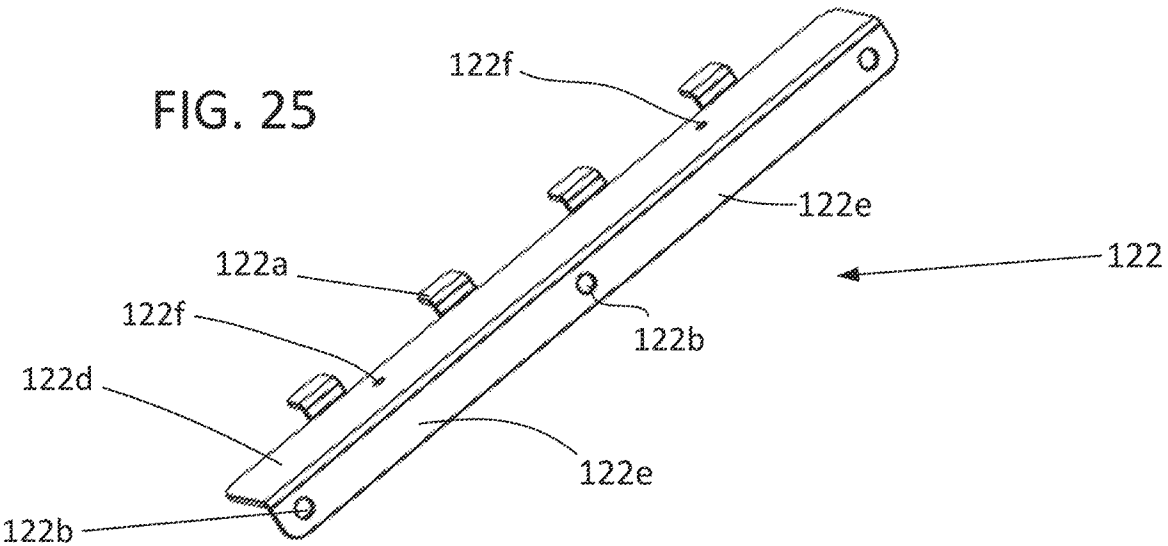
FIG. 25 is a perspective view of a first tensioner bracket of the fan assembly of FIG. 1.
Figure 26:
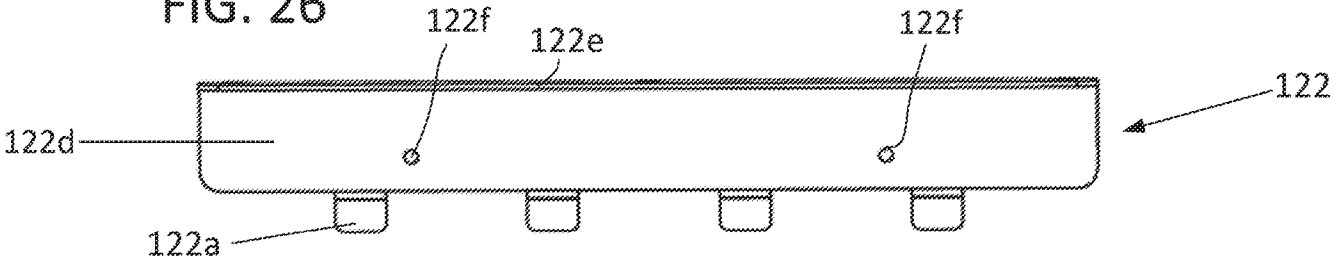
FIG. 26 is a top view of the first tensioner bracket of FIG. 25.
Figure 27:
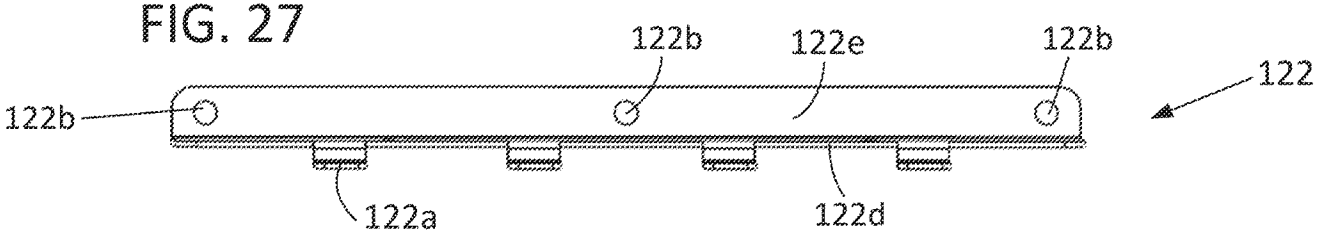
FIG. 27 is a side view of the first tensioner bracket of FIG. 25.
Figure 28:
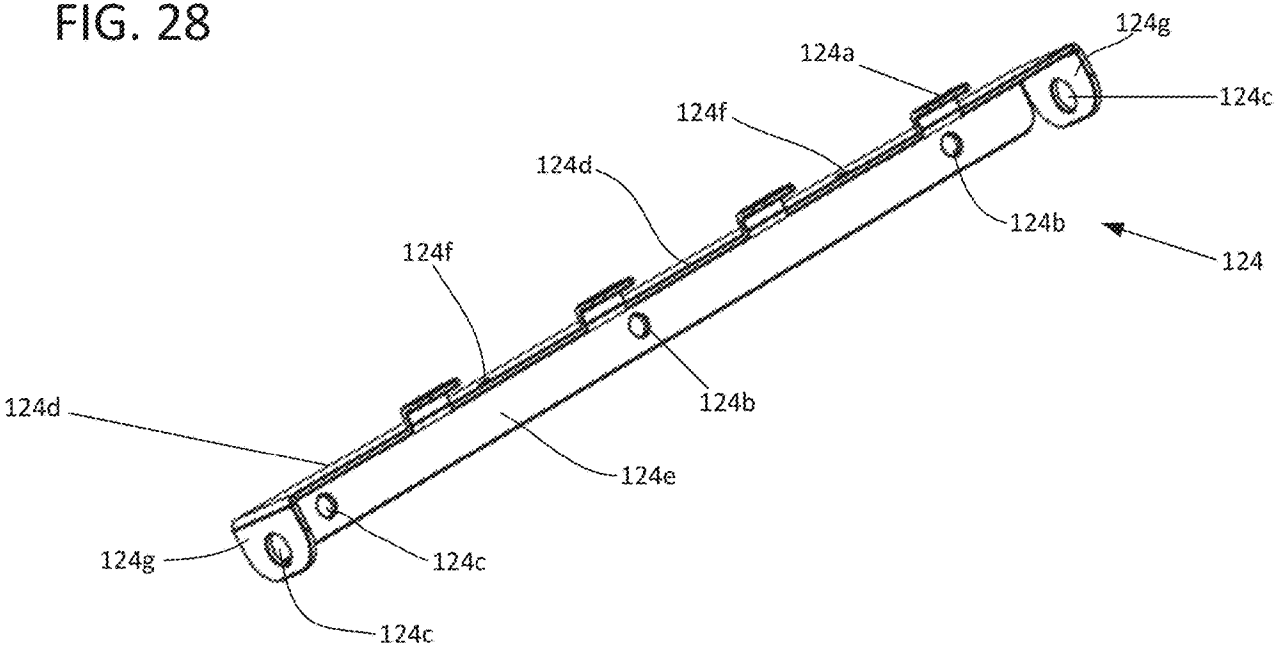
FIG. 28 is a perspective view of a second tensioner bracket of the fan assembly of FIG. 1.
Figure 29:
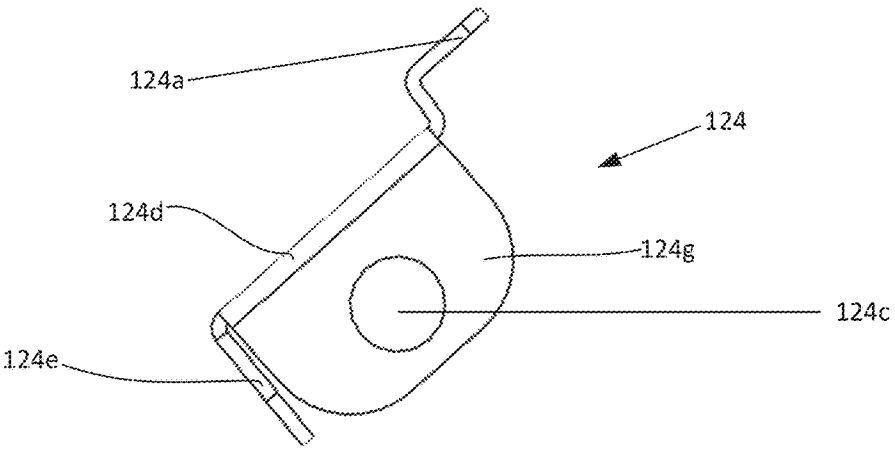
FIG. 29 is a side view of the second tensioner bracket of FIG. 28.
Figure 30:
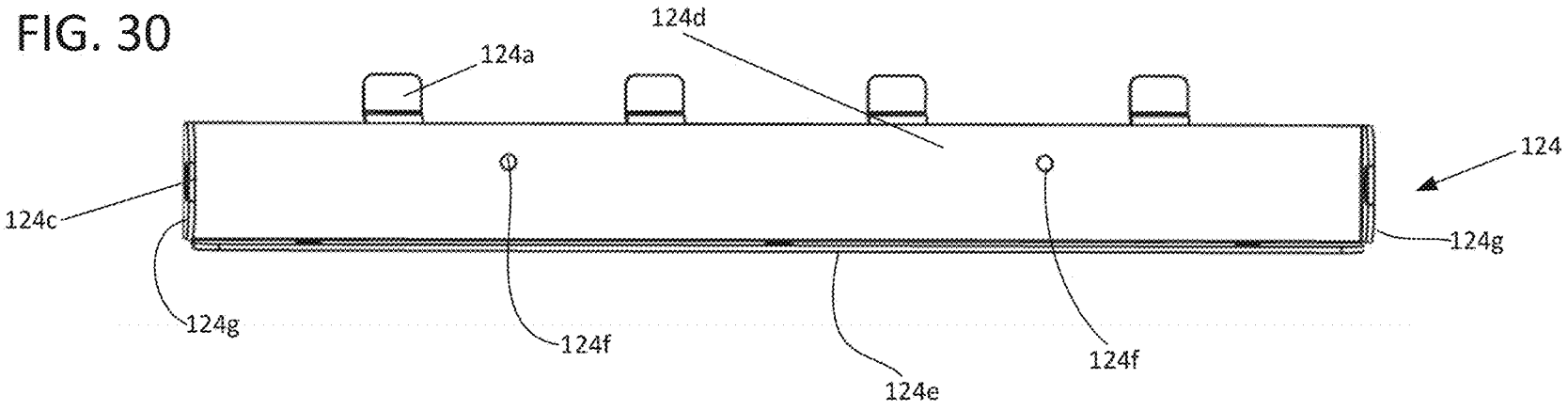
FIG. 30 is a side front view of the second tensioner bracket of FIG. 28.
Figure 31:
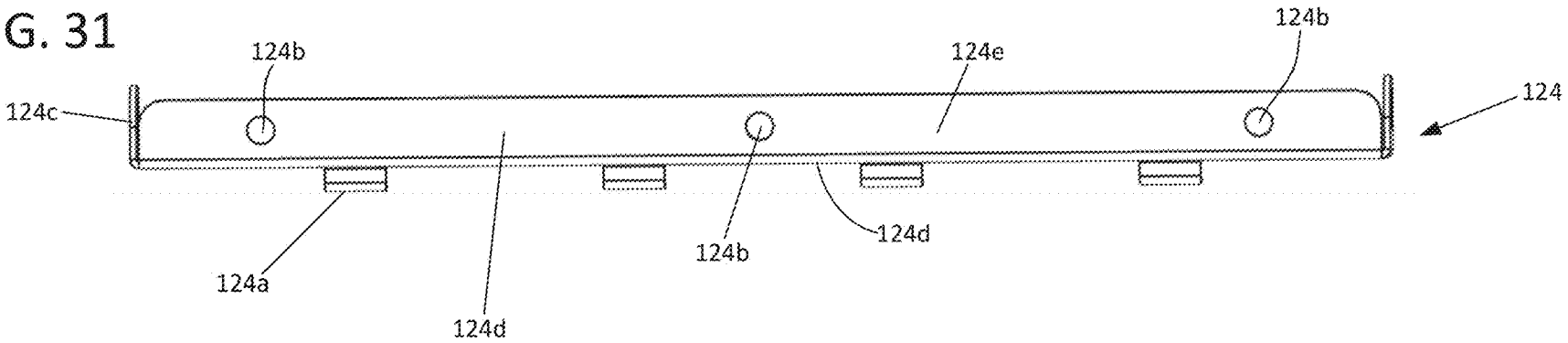
FIG. 31 is a top view of the second tensioner bracket of FIG. 28.
Figure 35:
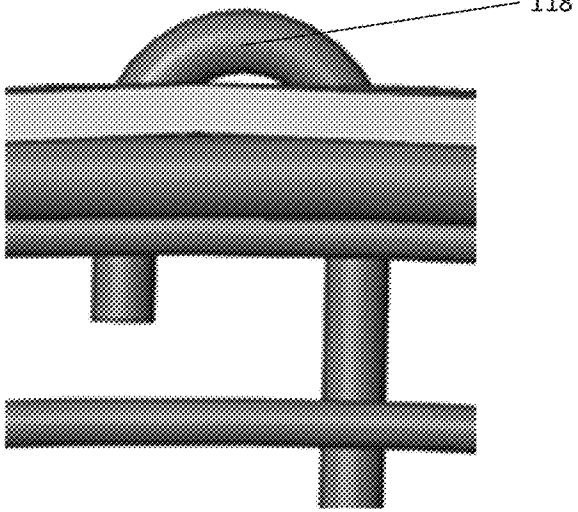
FIG. 35 is a side view of an example guard interlocking feature usable with the fan assembly of FIG. 1.
Figure 36:
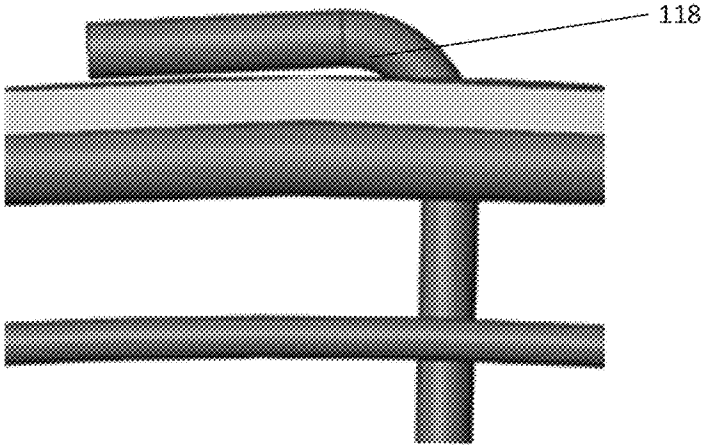
FIG. 36 is a side view of an example guard interlocking feature usable with the fan assembly of FIG. 1.
Figure 37:
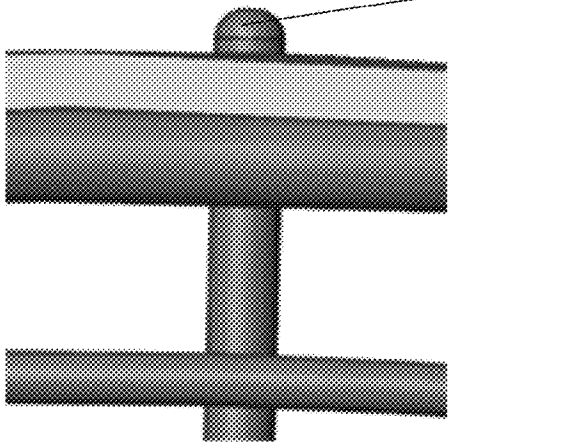
FIG. 37 is a side view of an example guard interlocking feature usable with the fan assembly of FIG. 1.

As most easily seen at FIG. 24, the guards 112, 114 have a generally circular shape and are formed as a welded wire frame. To enable the guards 112, 114 to be secured within the housing 110, each guard 112, 114 is provided with a plurality of radial extensions 118 that are received in corresponding apertures or slots 110*a* in the housing 110. The apertures or slots 110*a* are most easily viewed at FIGS. 17, 19, and 20. In the example shown, the apertures or slots 110*a* extend fully through the housing 110. However, other arrangements are possible wherein the apertures or slots 110*a* only extend partially through the wall thickness of the housing 110. In the example shown, the slots 110*a* are rectangular or racetrack shaped but can be configured with other shapes corresponding to a particular radial extension 118. In the example shown at FIGS. 1-4, 24, and 35, the radial extensions 118 are configured in the shape of a loop that extends into the apertures or slots 110*a*. Other configurations are possible. For example, as can be seen at FIGS. 35 to 37, the radial extensions 118 can be in the form of an L-shape or hook or in the form of a straight pin as well. Other shapes are also possible.

Figure 16:
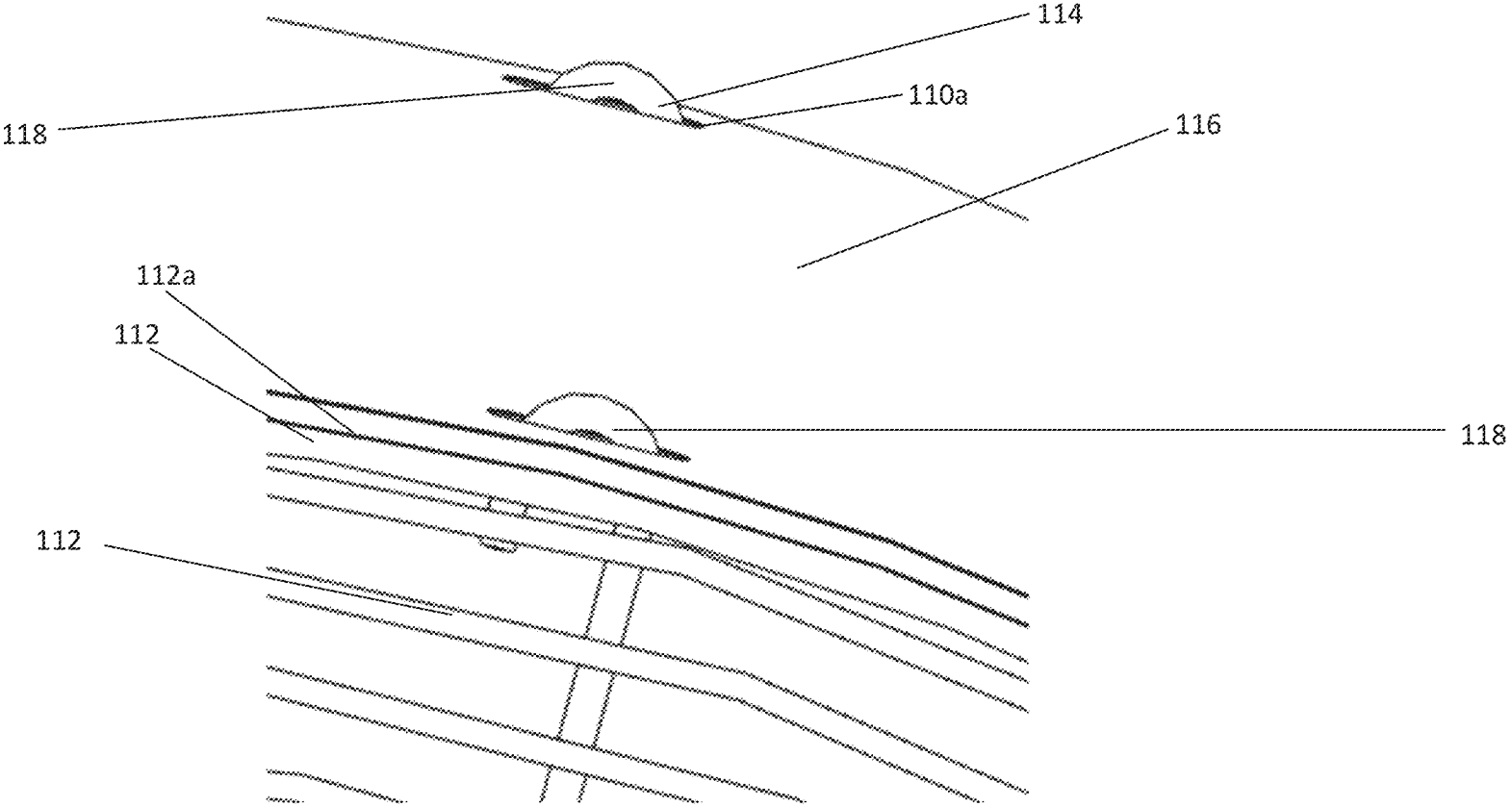
FIG. 16 is a partial perspective view of the fan assembly of FIG. 1 showing a guard radial extension.

With reference to FIG. 16, it can be seen that, regardless of the shape of the radial extension 118, the radial extensions 118 are received into the apertures or slots 110*a*. In this position, the outer perimeter 112*a*, 114*a* of the guards 112, 114 abuts the inside surface of the housing 110. Accordingly, when the housing 110 is tensioned by the tensioner mechanism 120, the configuration and operation of which is described below, the housing 110 will tighten against the outer perimeter 112*a*, 114*a* of the guards 112, 114 with the radial extensions 118 ensuring that the guards 112, 114 are held in place with respect to the housing 110. In the example shown, the outer perimeter 112*a* of the guards 112, 114 is an outermost wire ring of the guards 112, 114. However, the outer perimeter 112*a* could be formed by other features, if desired. Although the radial extensions 118 are shown as protrusions provided on the guards 112, 114 that extend into slots 110*a* on the housing 110, other configurations are possible. For example, the radial extensions 118 could be provided on the housing 110 and the slots 117 could be provided on the guards 112, 114.

Figure 6:
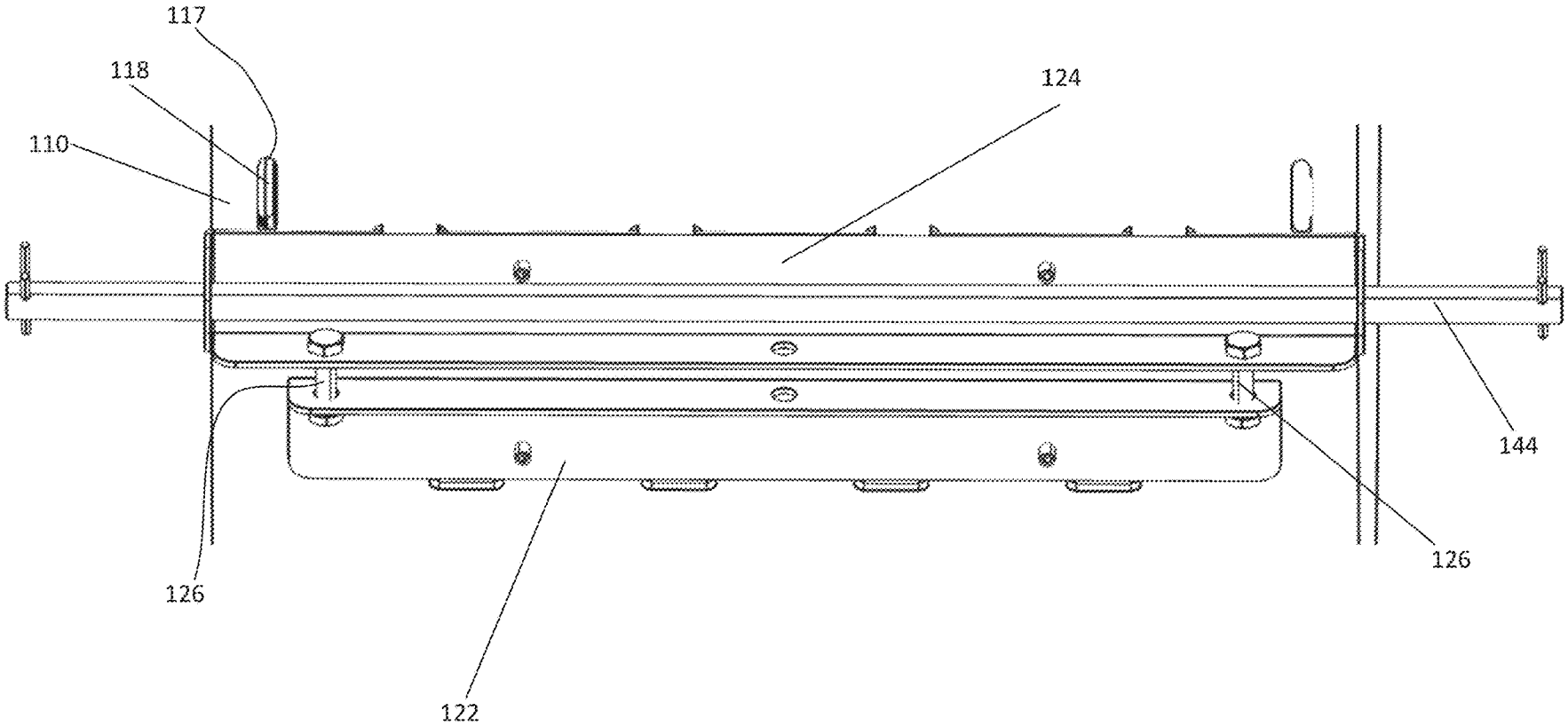
FIG. 6 is a perspective bottom view of a portion of the fan assembly of FIG. 1, showing a tensioner mechanism of the fan assembly.
Figure 7:
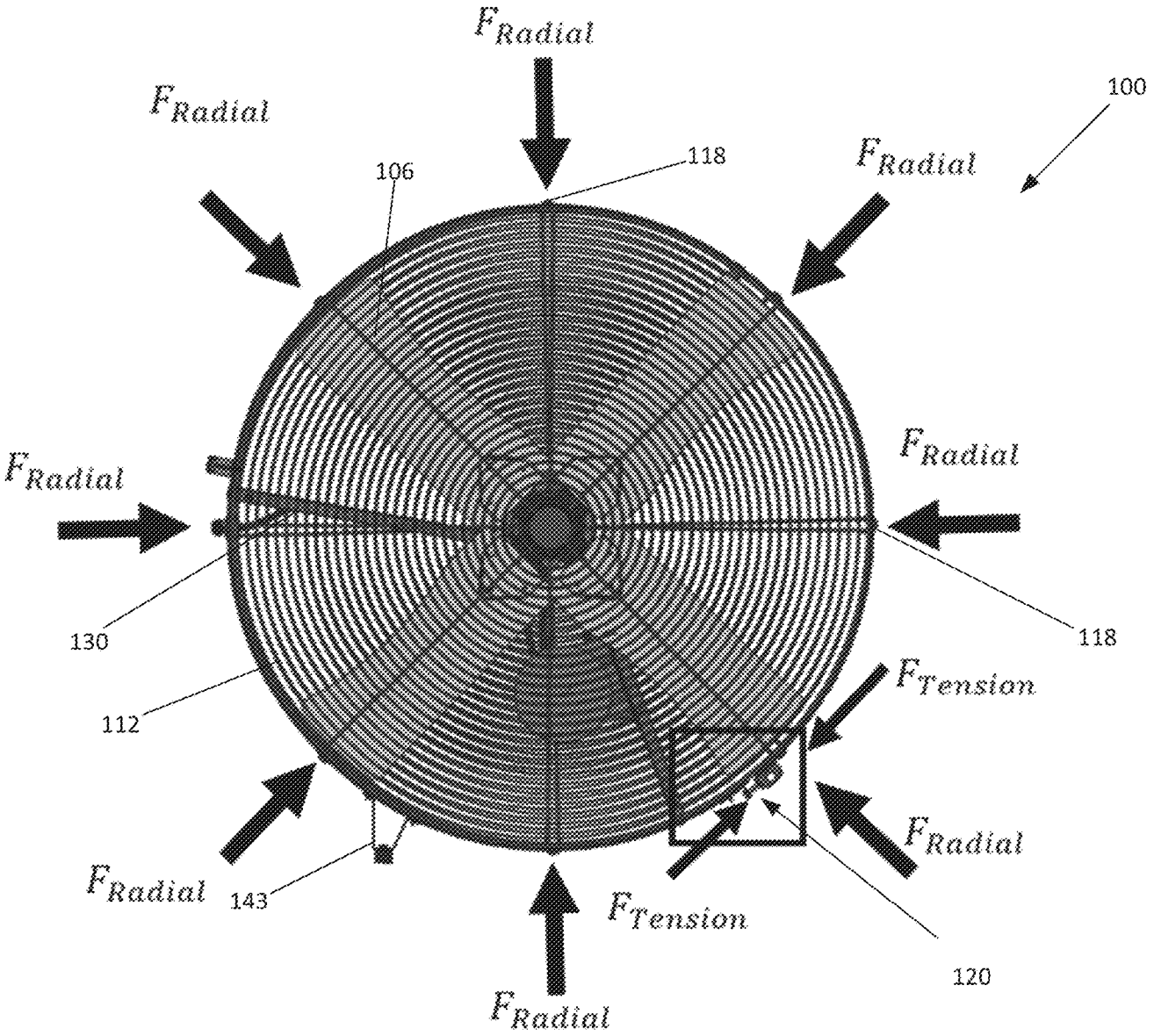
FIG. 7 is a front schematic view of the fan assembly of FIG. 1, highlighting a radial force around the fan and a tension force generated by the tensioner mechanism.
Figure 8:
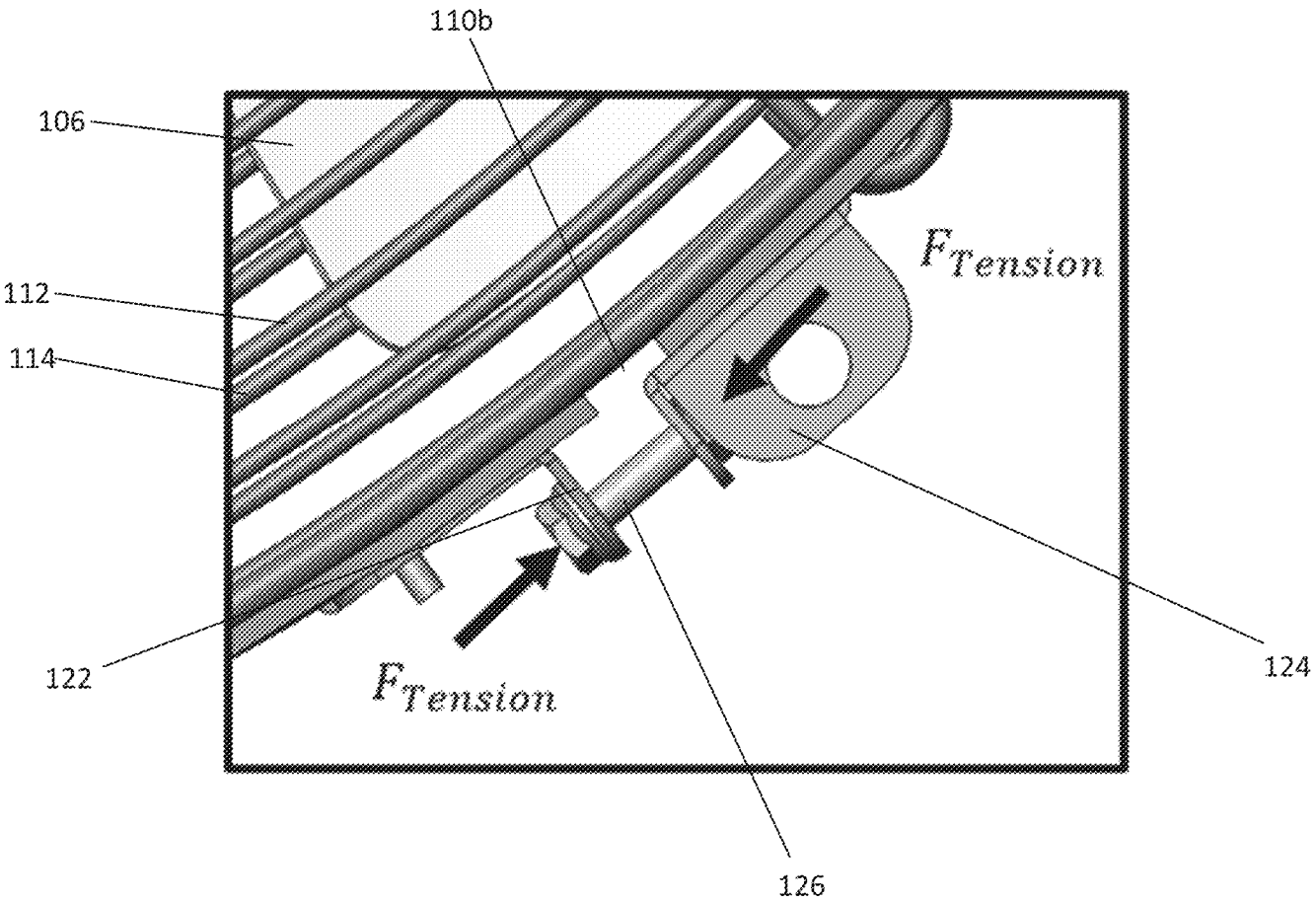
FIG. 8 is an enlarged view of the tensioner mechanism and fan assembly shown at FIG. 7.

Referring to FIGS. 6 to 13, the tensioner mechanism 120 is shown in more detail. In FIG. 6 the tensioner mechanism 120 is shown featuring a first tension bracket 122 and a second tension bracket 124. The tension brackets 122, 124 are positioned over a gap 110*b* in the housing 110, as can be most easily seen at FIGS. 8-9, 18, and 20. In one aspect, the housing 110 is formed from an initially flat polymeric or metal sheet and then folded or curved to form a circular shape, wherein the free ends 110*c*, 110*d* of the sheet form the gap 110*b*. In one aspect, the material which the housing 110 is made from will be sufficiently rigid to support the functions of the fan but flexible enough to allow for some room to flex when tensioned. In one aspect, the tension brackets 122, 124 are each secured to the housing 110 and are connected together by a tensioner 126, such as a pair of bolts, which provide tension and holds the housing 110 tightly together over the guards 112, 114. In one aspect, the first and second tension brackets 122, 124 are offset asymmetrically over the gap 110*b* so when they are held together with tension, the seam created from the gap 110*b* does not stand out and prevents objects from entering the housing 110. As shown in FIGS. 7 and 8, a radial force FRadial is applied equally around the housing 110. The radial force is a function of a tension force FTension created by the tensioner mechanism 120.

Figure 9:
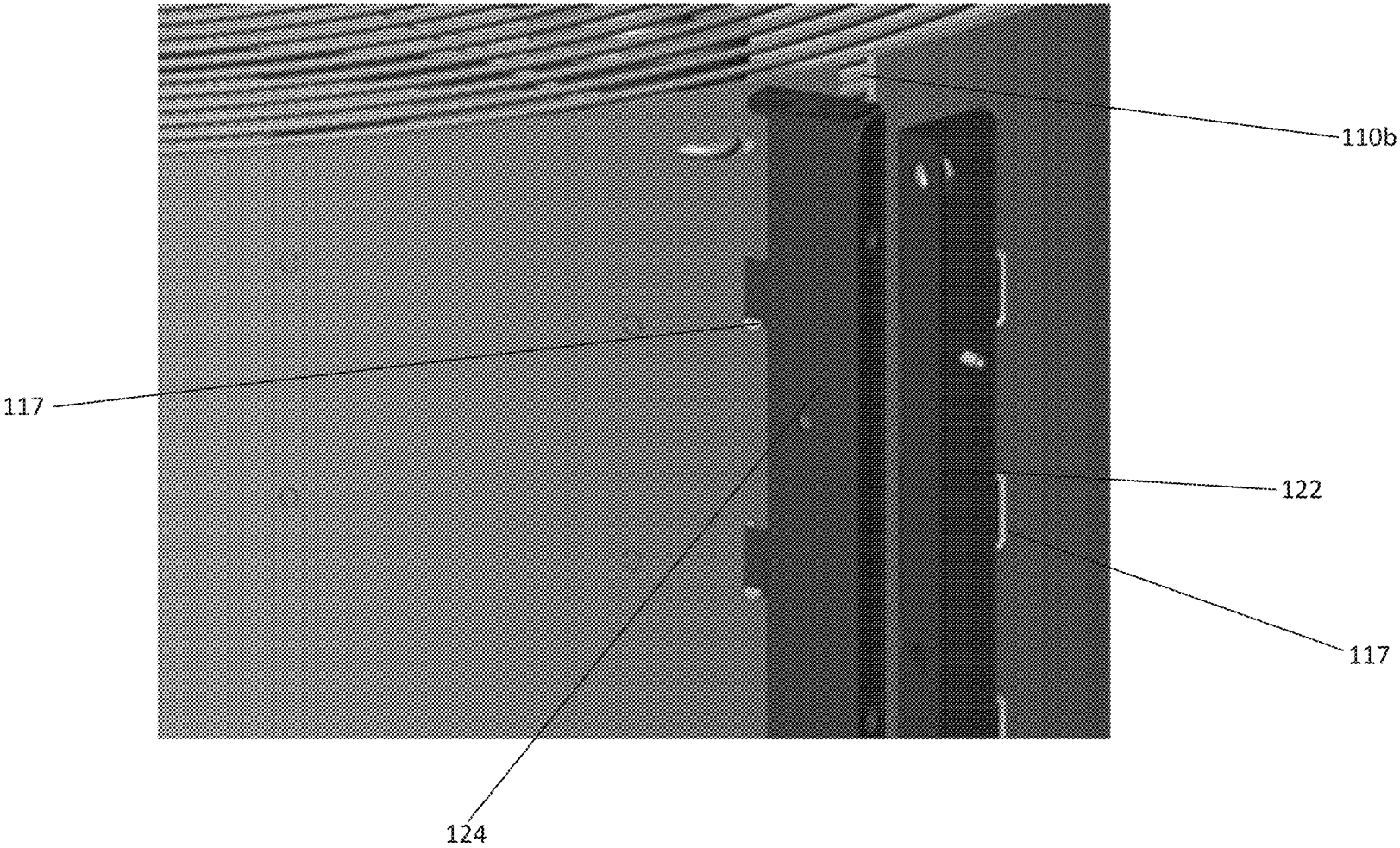
FIG. 9 is a perspective view of a portion of the fan assembly of FIG. 1, showing an assembly step in which a tensioner bracket of the tensioner mechanism is initially inserted into a tensioner slot on a housing of the fan assembly.
Figure 11:
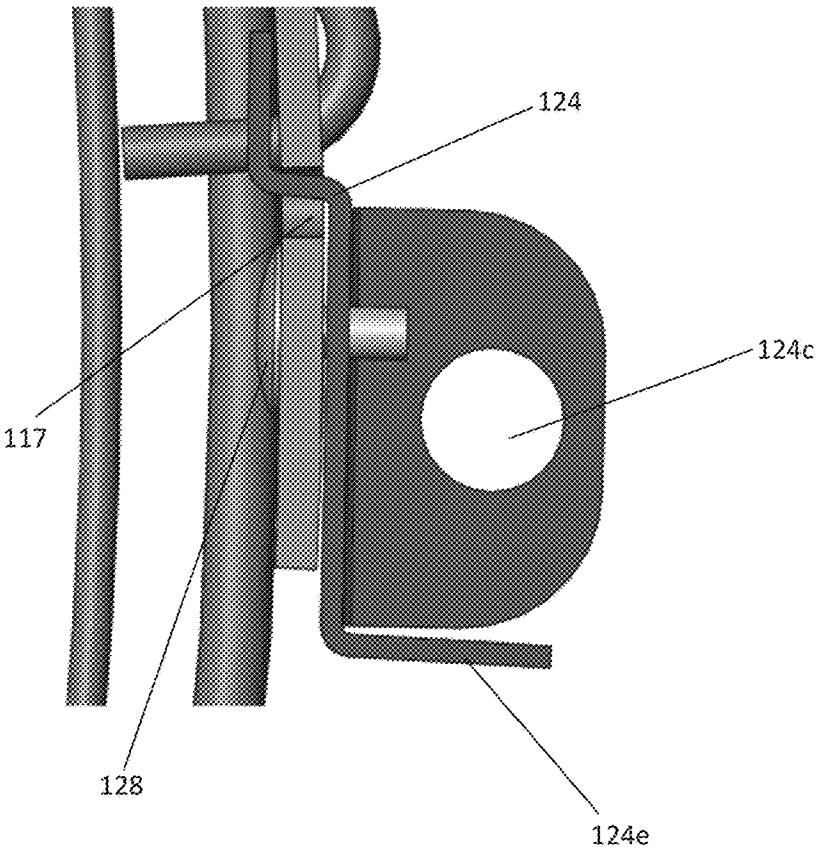
FIG. 11 is a cross-sectional view of the fan assembly of FIG. 1 and showing the tensioner bracket fully inserted and rotated into the tensioner slot.
Figure 10:
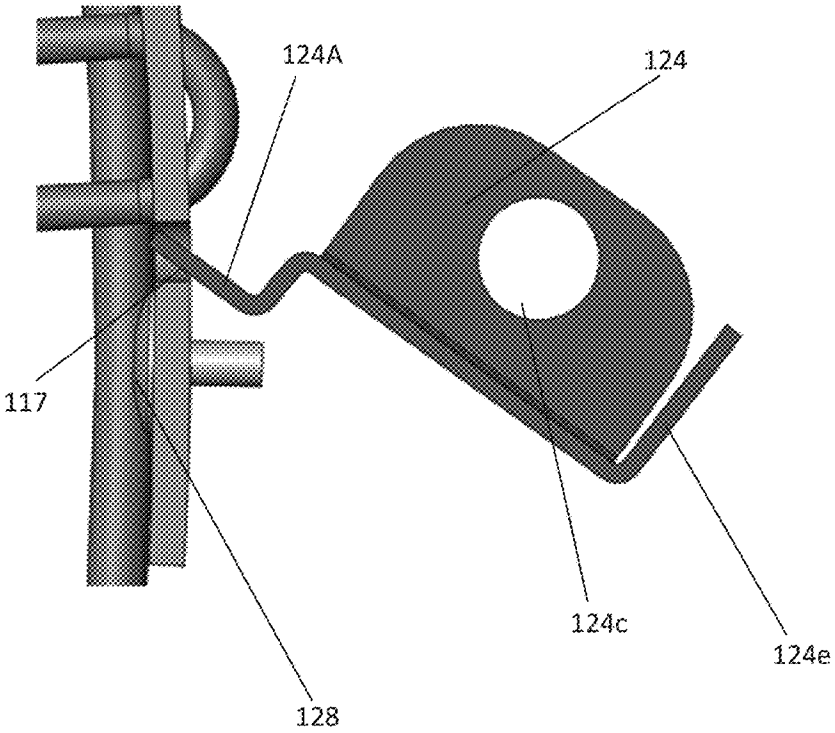
FIG. 10 is a cross-sectional view of the fan assembly of FIG. 1 and showing the tensioner bracket in the initial position shown at FIG. 9.
Figure 12:
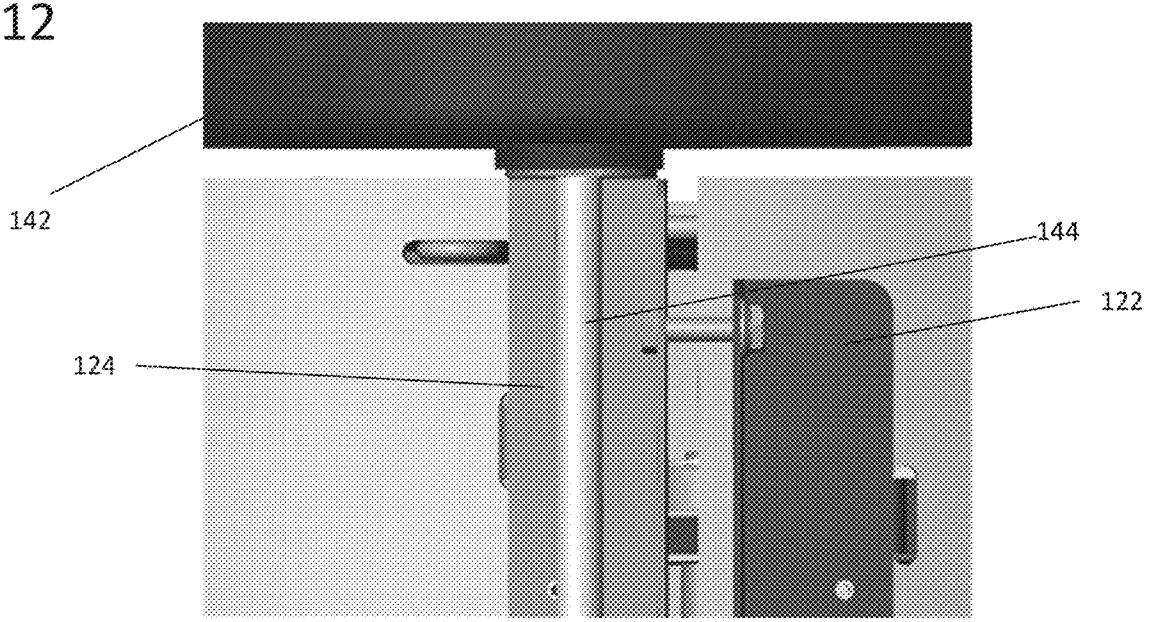
FIG. 12 is a bottom view of a portion of the fan assembly of FIG. 1 and showing a portion of the tensioner mechanism.
Figure 13:
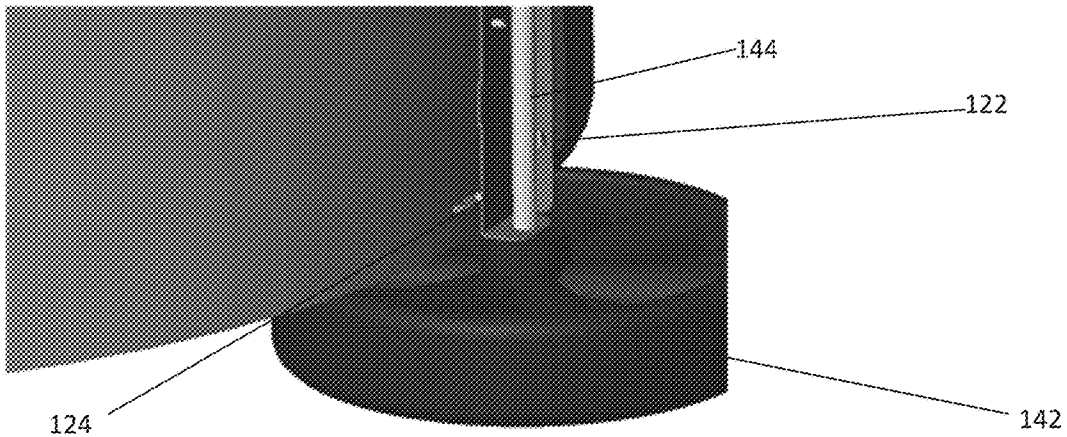
FIG. 13 is a bottom perspective view of a portion of the fan assembly of FIG. 1 and showing a portion of the tensioner mechanism.
Figure 14:
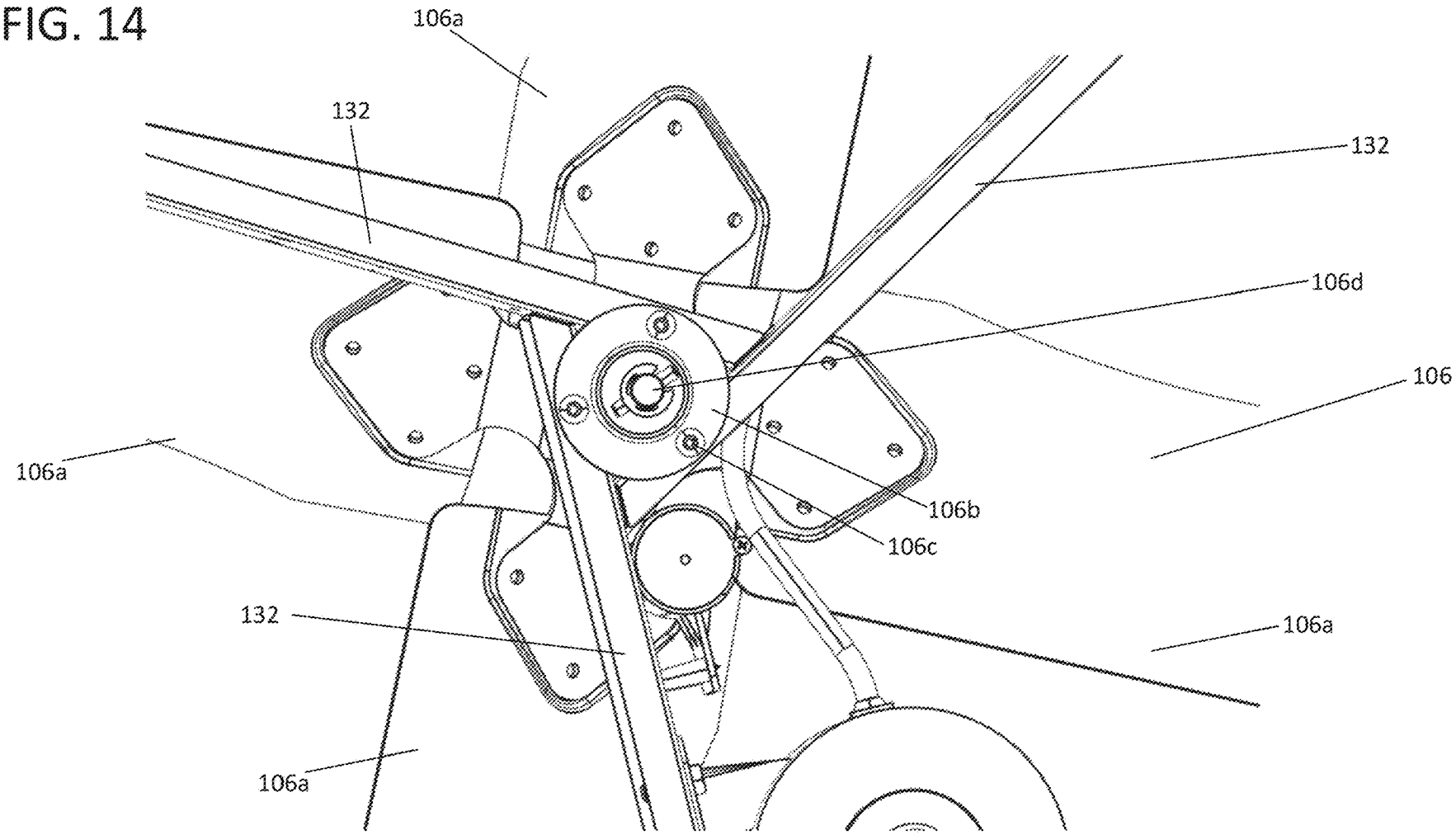
FIG. 14 is a front view of a portion of the fan assembly of FIG. 3 and showing a portion of the fan blades, motor, and support assembly.

The installation of the tensioner mechanism 120 onto the housing 110 is shown at FIGS. 9 to 11. The second tensioner bracket 124 is shown in FIG. 10 whereby a plurality of L-shaped or bent tabs 124*a* are inserted into corresponding slots 117 on the housing 110. After the tabs 124*a* of the bracket 124 are inserted into the slots 117, as is shown at FIG. 11, the bent portion of the tabs 124*a* engage with the housing 110 such that tension on the housing 110 is effectuated through the interaction between the tabs 124*a* and the edge of the slots 117. The first tension bracket 122 is provided with similarly configured tabs 122*a* which function in the same manner. In one aspect, each of the tabs 122*a*, 124*a* abuts against the interior 111 of the housing 110 providing support to the tab and creating a friction force and assists tensioner brackets 122, 124 in holding the housing 110 in place. In one aspect, the brackets 122, 124 include a main segment 122*d*, 124*d* which rest against the exterior surface 116. The main segment 122*d*, 124*d* can include apertures 122*f*, 124*f* for receiving fasteners 128 for securing the brackets 122, 124 to the housing 110. In one aspect, the tabs 122*a*, 124*a* extend from the main segments 122*d*, 124*d*. In one aspect, second bent portions or flanges 122*e*, 124*e* also extend from the main segments 122*d*, 124*d* at a generally right angle. The second bent portions or flanges 122*e*, 124*e* can include apertures or holes 122*b*, 124*b* to allow the tensioner bolts 126 (or other tensioning mechanism) to provide tension to hold the brackets 122, 124 together, which in turn provides the necessary tension to hold the housing 110 together when the bolts 126 are tightened. In the example shown, the second bracket 124 can include a pair of flanges 124*g* defining aperture 124*c* through which the common axle 144, to which the wheels 142 are mounted, can pass through, as shown in FIGS. 12 and 13.

In the embodiment shown, there are four tabs 124*a* on the second tension bracket and four tabs 122*a* on the second tensioning bracket. Each of the tabs 124*a*, 122*a*, discussed above, are configured to be inserted into four slots 117 on the housing 110. It will be appreciated that other configurations featuring more or less slots 117 can be added if required.

In some embodiments, before the tensioner mechanism 120 is installed and tightened on the housing 110, the housing 110 has a first diameter and when the tension bracket 124 is configured onto the housing 110 the housing 110 has a second diameter which is less than the first diameter. Such a configuration allows for the guards 112, 114 to be placed into the housing 110 and aligning the 118 with the 110*a* prior to the tensioner mechanism 120 being installed and tightened to the housing 110, once the tensioner mechanism 120 is installed and tightened, thus providing tension to the housing 110, the diameter is reduced of the overall housing 110 is reduced to the second diameter and the 118 become fixed within the 110*a* of the housing 110. The reduction of the diameter comes primarily from the gap 110*b* being tightened by the tensioner mechanism 120.

Figure 32:
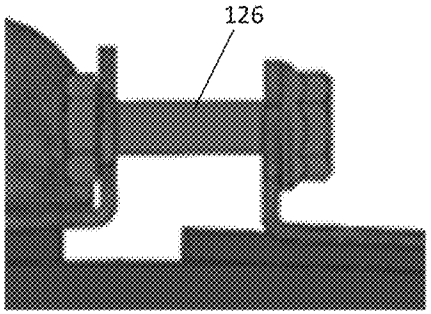
FIG. 32 is side view of an example tensioner usable with the tensioner mechanism of the fan assembly of FIG. 1.
Figure 33:
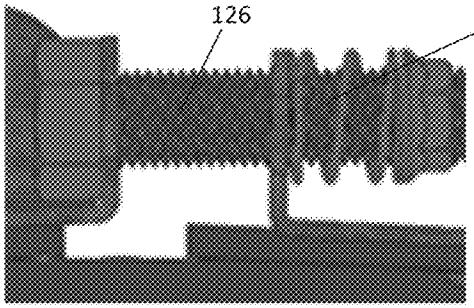
FIG. 33 is side view of an example tensioner usable with the tensioner mechanism of the fan assembly of FIG. 1.
Figure 34:
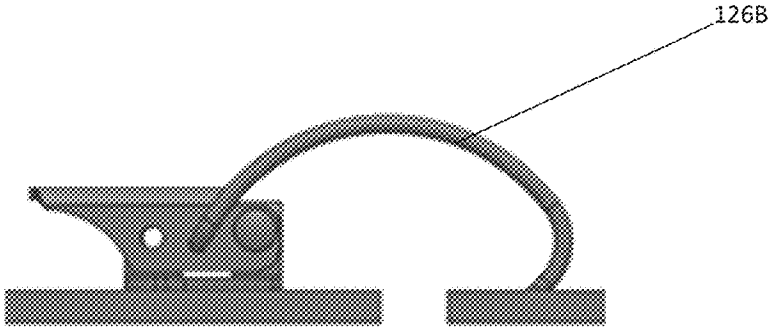
FIG. 34 is side view of an example tensioner usable with the tensioner mechanism of the fan assembly of FIG. 1.

With reference to FIGS. 32 to 34, various ways that the tensioner mechanism 120 could be implemented are presented. FIG. 32 shows an example with a bolt 126. FIG. 33 shows an example with both a bolt 126 and a spring 126*a* providing tension. FIG. 34 shows an example with a draw latch 126*b* as the tensioner mechanism 120. Various other mechanisms can also be used to provide tension to the housing 110.

Figure 38:
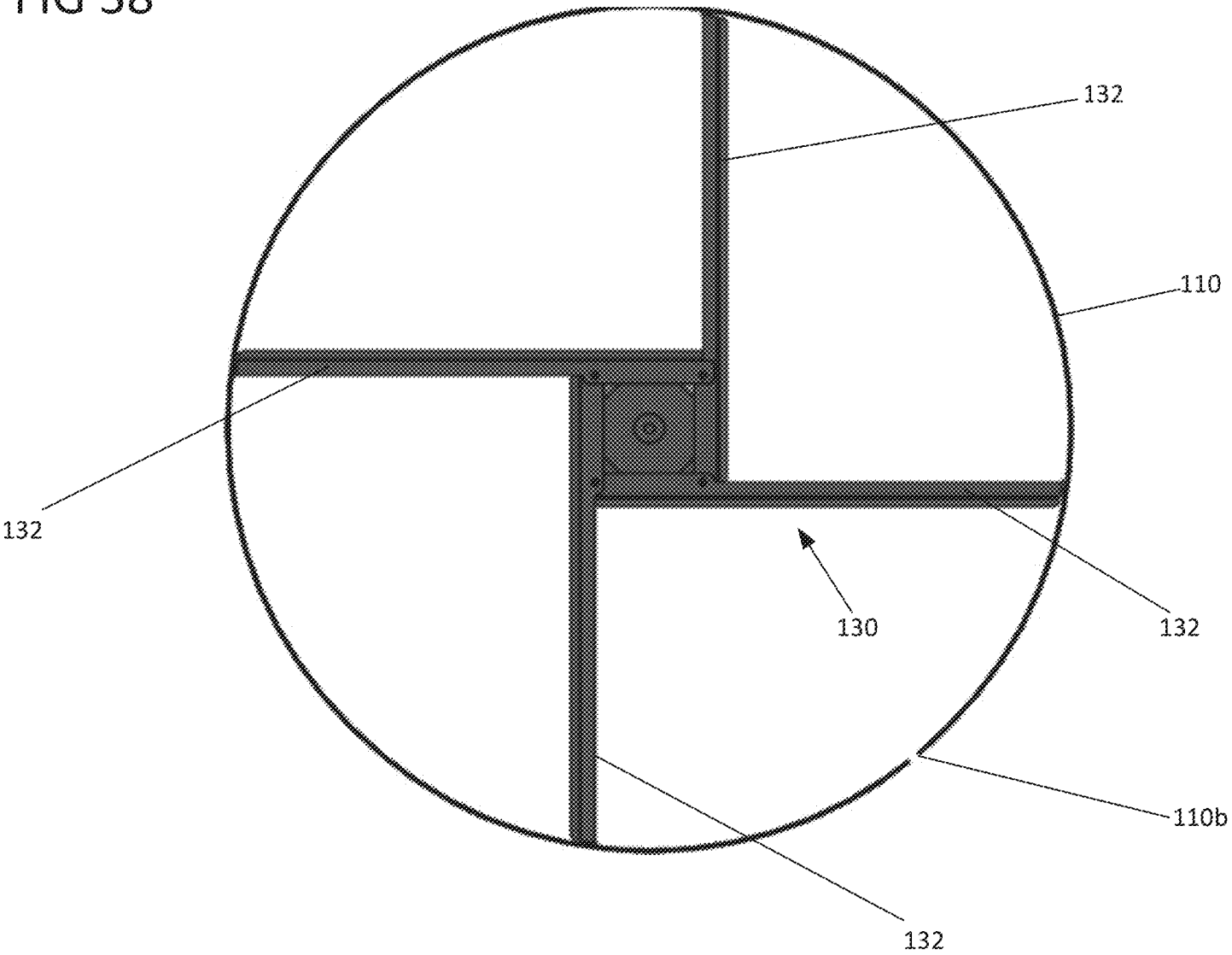
FIG. 38 is a side view of an example support assembly and housing usable with the fan assembly shown in FIG. 1.

With reference to FIG. 38, an alternative configuration of the support assembly 130 is shown utilizing four interconnected struts 132. Other configurations can also be made, for example assemblies using two struts 132 or more than four struts 132. In an ideal embodiment, the number of struts 132 does not equal the number of fan blades 106*a* and the struts 132 are arranged such that the fan blades 106*a* do not pass over all of the struts 132 at the same time. Such a configuration lowers the pressure load on the strut 132 as fewer blades pass over the support structure 130 at the same time, reducing the cyclic load that can cause resonance at natural frequencies or wobble. The support structures 130 also provide improved twist stability and load distribution over prior art configurations using a standard common two-support system in a vertical column manner.

It will be appreciated that the housing 110 and tensioner mechanism 120 can be configured to contain other mechanisms which are not fans as a way of quickly assembling a mechanism that requires a similar housing 110 to that which was described above. The size and scale can additionally be reduced for quick assembly of smaller scale fans. As discussed earlier, the housing 110 and tensioner mechanism 120 greatly reduce manufacturing time by eliminating the need for a plurality of fasteners to be configured about the exterior of the housing 110 as well as a reduction in manufacturing inventory of parts.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed is:

1. A fan assembly comprising:

a housing defining an inner surface and extending between an inlet end and an outlet end;

a fan and a motor disposed within the housing;

a first guard defining a first outer perimeter and being located proximate the housing inlet end;

a second guard defining a second outer perimeter and being located proximate the housing outlet end;

a tensioner mechanism securing the first and the second guards to the housing by drawing a first end of the housing towards a second end of the housing such that the inner surface of the housing is tightened against the first and second outer perimeters of the first and second guards, wherein the first and second guards each include one or more radial extensions extending into apertures defined within the housing; and a pair of wheels supported by an axle, wherein the axle is supported by the tensioner mechanism.

2. The fan assembly of claim 1, wherein the tensioner mechanism includes one or more tensioner bolts.

3. The fan assembly of claim 2 wherein the tensioner mechanism further includes a spring.

4. The fan assembly of claim 1, wherein the tensioner mechanism is a draw latch.

5. The fan assembly of claim 1, wherein each of the radial extensions is configured as one of a wire loop, a wire hook, and a straight pin.

6. The fan assembly of claim 1, further comprising:

a) at least two struts extending to the inner surface of the housing to provide support for the motor and fan.

7. The fan assembly of claim 6, wherein there are three struts extending to the inner surface of the housing.

8. The fan assembly of claim 6, wherein there are four or more struts extending to the inner surface of the housing.

9. A fan assembly comprising: a housing extending between an inlet end and an outlet end; a fan and a motor disposed within the housing; a first guard located proximate the housing inlet end; a second guard spaced apart from the first guard located proximate the housing outlet end; and a pair of wheels supported by an axle; wherein the first and second guards each include a plurality of radial extensions extending beyond an outer main perimeter of the respective guard and an outer surface of the housing through corresponding apertures defined within the housing, wherein the housing is tightened against the outer main perimeters of the first and second guards by a tensioner mechanism to define an interior space within which the fan and motor are disposed.

10. The fan assembly of claim 9, wherein each of the radial extensions is configured as a wire loop.

11. The fan assembly of claim 9, wherein each of the radial extensions is configured as a wire hook.

12. The fan assembly of claim 9, wherein each of the radial extensions is configured as a straight pin.

13. The fan assembly of claim 9, further comprising:

a) at least two struts located in the interior space of the housing to provide support for the motor and the fan.

14. The fan assembly of claim 13, wherein there are three struts provided in the interior space of the housing.

15. The fan assembly of claim 14, wherein there are four or more struts provided in the interior space of the housing.

16. A fan assembly comprising: a housing assembly including a first guard, a second guard spaced apart from the first guard, and a flexible sheet wrapped about outer perimeters of the first and second guards such that radial extensions of the first and second guards extend through and beyond corresponding apertures within the flexible sheet, the first and second guards and flexible sheet defining an interior space, wherein the flexible sheet is secured to the first and second guards by drawing a first end of the flexible sheet towards a second end of the flexible sheet such that an inner surface of the flexible sheet is tightened against the outer perimeters of the first and second guards; and a fan and a motor located within the interior space and supported by the housing assembly.

17. The fan assembly of claim 16, further comprising:

a) a support assembly secured to the flexible sheet and supporting the fan and motor.

18. The fan assembly of claim 16, further comprising: a) a first bracket secured to the first end of the flexible sheet; b) a second bracket secured to the second end of the flexible sheet; and c) a tensioner mechanism drawing the first and second brackets towards each other to tension the flexible sheet about the first and second guards.

* * * * *